US007535326B2

(12) United States Patent
Nakatani et al.

(10) Patent No.: US 7,535,326 B2
(45) Date of Patent: May 19, 2009

(54) MICROSWITCHING ELEMENT

(75) Inventors: Tadashi Nakatani, Kawasaki (JP); Anh Tuan Nguyen, Kawasaki (JP); Takeaki Shimanouchi, Kawasaki (JP); Masahiko Imai, Kawasaki (JP); Satoshi Ueda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 296 days.

(21) Appl. No.: 11/245,007

(22) Filed: Oct. 7, 2005

(65) Prior Publication Data

US 2006/0181375 A1 Aug. 17, 2006

(30) Foreign Application Priority Data

Jan. 31, 2005 (JP) ..... 2005-023388

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,578,976 A * 11/1996 Yao ..... 333/262
6,238,946 B1 5/2001 Ziegler
6,307,452 B1 10/2001 Sun
6,734,770 B2 * 5/2004 Aigner et al. ..... 335/78
6,750,742 B2 * 6/2004 Kang et al. ..... 333/262
7,123,119 B2 * 10/2006 Pashby et al. ..... 333/262
7,151,425 B2 * 12/2006 Park et al. ..... 333/262

FOREIGN PATENT DOCUMENTS

JP 9-17300 1/1997
JP 2001-94062 4/2001
JP 2001-143595 5/2001

* cited by examiner

*Primary Examiner*—Elvin G Enad
*Assistant Examiner*—Bernard Rojas
(74) *Attorney, Agent, or Firm*—Kratz, Quintos & Hanson, LLP.

(57) ABSTRACT

A microswitching element includes a base substrate, a fixing portion attached to the base substrate, and a movable portion including a fixed end fixed to the fixing portion. The movable portion is surrounded by the fixing portion via a slit having a pair of closed ends. The movable portion includes a first surface and a second surface. The first surface faces the base substrate, and the second surface is opposite to the first surface. The microswitching element also includes a movable contact portion provided on the second surface of the movable portion, and a pair of fixed contact electrodes each including a contact surface facing the movable contact portion. The fixed contact electrodes are attached to the fixing portion.

11 Claims, 29 Drawing Sheets

S'
101
103
102

31
101

33
41
41
101

41
104
41
41
101

MICROSWITCHING ELEMENT

BACKGROUND OF THE INVENTION

1. Field of the Invention

The present invention relates to a miniature switching element that is fabricated by using MEMS technology.

2. Description of the Related Art

In the technological field of wireless communication devices such as cellular phones, a demand for miniaturization of high-frequency circuits and RF circuits has arisen in accordance with the increase in the parts that are mounted in order to implement a high performance. In order to meet such a demand, advances have been made in the miniaturization by using MEMS (micro-electromechanical systems) technology of a variety of parts constituting a circuit.

As one such part, a MEMS switch is known. The MEMS switch is a switching element in which each part is made miniature by means of MEMS technology and comprises at least a pair of contacts for executing switching through mechanical opening and closing and a drive mechanism for achieving the mechanical opening closing operation of the contact pair. MEMS switches tend to exhibit higher insulation in an open state and lower insertion loss in a closed state than switching elements made of PIN diodes and MESFETs and so forth in the switching of a GHz-order high frequency signal in particular. This is attributable to the fact that an open state is achieved by means of mechanical opening between the contact pair and to the small parasitic capacitance on account of being a mechanical switch. MEMS switches appear in Japanese Patent Application Laid Open Nos. H9-17300 and 2001-143595, for example.

FIGS. 32 and 33 show a microswitching element X6, which is an example of a conventional MEMS switch. FIG. 32 is a partial planar view of the microswitching element X6 and FIG. 33 is a cross-sectional view thereof along the line XXXIII-XXXIII in FIG. 32. The microswitching element X6 comprises a substrate 601, a fixing portion 602, a movable portion 603, a movable contact portion 604, a pair of fixed contact electrodes 605, and drive electrodes 606 and 607. The fixing portion 602 is joined to the substrate 601 and the movable portion 603 extends along the substrate 601 from the fixing portion 602. The movable contact portion 604 is provided on the underside of the movable portion 603 and the drive electrode 606 is provided over the fixing portion 602 and movable portion 603. The pair of fixed contact electrodes 605 forms a pattern on the substrate 601 so that each end faces the movable contact portion 604. The drive electrode 607 is disposed on the substrate 601 in a position corresponding to the drive electrode 606 and connected to ground. Further, a prescribed wiring pattern (not illustrated) that is electrically connected to the fixed contact electrodes 605 or drive electrode 607 is formed on the substrate 601.

When a prescribed electric potential is supplied to the drive electrode 606 of a microswitching element X6 with this constitution, an electrostatic force of attraction is produced between the drive electrodes 606 and 607. As a result, the movable portion 603 is elastically deformed to a position where the movable contact portion 604 contacts both fixed contact electrodes 605. Thus, the closed state of the microswitching element X6 is achieved. In the closed state, the pair of fixed contact electrodes 605 is electrically connected by the movable contact portion 604 and current is allowed to pass between the fixed contact electrode pair 605.

Meanwhile, when the electrostatic force of attraction acting between the drive electrodes 606 and 607 in the microswitching element X6 in the closed state ceases to exist, the movable portion 603 returns to the natural state and the movable contact portion 604 is spaced apart from the fixed contact electrodes 605. Thus, the open state of the microswitching element X6 as shown in FIG. 33 is achieved. In the open state, the pair of fixed contact electrodes 605 is electrically isolated and the passage of current between the fixed contact electrode pair 605 is prevented.

FIGS. 34 and 35 show the steps of a part of the fabrication method of the microswitching element X6. In the fabrication of the microswitching element X6, each of the fixed contact electrodes 605 and the drive electrode 607 are first formed by patterning on the substrate 601 as shown in FIG. 34A. More specifically, after a prescribed electrically conductive material is deposited on the substrate 601, a prescribed resist pattern is formed on the electrically conductive film by means of photolithography and the electrically conductive film is etched with the resist pattern serving as a mask. Thereafter, a sacrificial layer 610 is formed as shown in FIG. 34B. More specifically, a prescribed material is deposited or grown on the substrate 601 while covering the pair of fixed contact electrodes 605 and the drive electrode 607 by sputtering, for example. Thereafter, one recess 611 is formed at a point on the sacrificial layer 610 corresponding to the pair of fixed contact electrodes 605 as shown in FIG. 34C by means of etching by using a prescribed mask. Next, as shown in FIG. 34D, the movable contact portion 604 is formed by depositing a prescribed material in the recess 611 as shown in FIG. 34D.

Thereafter, as shown in FIG. 35A, a material film 612 is formed by sputtering, for example. Next, as shown in FIG. 35B, the drive electrode 606 is formed by patterning on the material film 612. More specifically, after a prescribed electrically conductive film has been deposited on the material film 612, a prescribed resist pattern is formed on the electrically conductive film by means of photolithography and etching is performed on the electrically conductive film with the resist pattern serving as a mask. Thereafter, as shown in FIG. 35C, a film body 613 that constitutes the movable portion 603 and part of the fixing portion 602 is formed by patterning the material film 612. More specifically, a prescribed resist pattern is formed on the material film 612 by means of photolithography and then the material film 612 is etched with the resist pattern serving as a mask. Thereafter, the fixing portion 602 and movable portion 603 are formed as shown in FIG. 35D. More specifically, while introducing an undercut below the movable portion 603, isotropic etching is performed on the sacrificial layer 610 via the film body 613 that functions as an etching mask so that part of the sacrificial layer 610 is residually formed as part of the fixing portion 602.

Low insertion loss in the closed state may be cited as one characteristic that is generally required of a switching element. Further, after attempting a reduction of the insertion loss of the switching element, a low electrical resistance for the pair of fixed contact electrodes is desirable.

However, in the case of the above microswitching element X6, it is difficult to establish thick fixed contact electrodes 605 and, in reality, the fixed contact electrodes 605 are thick and on the order of 2 μm. This is because of the need to secure evenness for the illustrated upper face (growth end face) of the sacrificial layer 610 that was formed temporarily in the fabrication steps of the microswitching element X6.

As mentioned earlier with reference to FIG. 34B, the sacrificial layer 610 is formed by depositing or growing a prescribed material on the substrate 601 while covering the pair of fixed contact electrodes 605. As a result, a step (not shown) that matches the thickness of the fixed contact electrodes 605 is produced on the growth end face of the sacrificial layer 610. The thicker the fixed contact electrode 605 is, the larger the step and, as the step increases, there is a tendency for the formation of the movable contact portion 604 in a suitable position and the formation of the movable portion 603 with the appropriate shape to be problematic. Further, when the fixed contact electrodes 605 are as thick as or thicker than a fixed amount, the sacrificial layer 610 that is deposited and formed on the substrate 601 sometimes breaks on account of the thickness of the fixed contact electrodes 605. When the sacrificial layer 610 breaks, it is not possible to suitably form a movable contact portion 604 or movable portion 603 on the sacrificial layer 610. Therefore, it is necessary to make the fixed contact electrodes 605 sufficiently thin so that an unreasonable step is not produced in the growth end face of the sacrificial layer 610 in the microswitching element X6. For this reason, it is sometimes difficult to implement a sufficiently low resistance for the fixed contact electrodes 605 in the microswitching element X6 and, as a result, it is sometimes impossible to implement a low insertion loss.

SUMMARY OF THE INVENTION

The present invention was conceived in view of this situation and an object thereof is to provide a microswitching element that is adapted to reduce the insertion loss and which can be suitably fabricated.

The microswitching element provided by the present invention comprises a base substrate; a fixing portion attached to the base substrate; a movable portion that includes a fixed end fixed to the fixing portion, and that extends along the base substrate to be surrounded by the fixing portion via a slit having a pair of closed ends, the movable portion including a first surface facing the base substrate and a second surface opposite to the first surface; a movable contact portion provided on the second surface of the movable portion; and a pair of fixed contact electrodes each of which includes a contact surface facing the movable contact portion. The fixed contact electrodes are attached to the fixing portion.

This microswitching element fulfils a switching function by the mechanical opening and closing of a movable contact portion and a pair of fixed contact electrodes. In the case of this microswitching element, the pair of fixed contact electrodes are each fixed via a fixing portion to a base substrate and have a part facing the movable contact portion that is provided on the side opposite the base substrate of the movable portion.

According to the present invention, the pair of fixed contact electrodes are not disposed between the base substrate and the movable portion. Therefore, when this element is fabricated, there is no need to undertake the above series of steps pertaining to a conventional microswitching element X6 of forming a pair of fixed contact electrodes on the base substrate, forming a sacrificial layer to cover the fixed contact electrodes, and forming a movable portion on the sacrificial layer. The pair of fixed contact electrodes 605 of this element can be formed by depositing or growing a material by means of plating, for example, on the opposite side from the base substrate via the movable portion. As a result, it is possible to afford the pair of fixed contact electrodes of this element a thickness that is sufficient to implement the desired low resistance. This kind of microswitching element is suitable on account of the reduction in the insertion loss.

More specifically, this microswitching element can be fabricated by subjecting a material substrate with a layered structure consisting of a first layer, a second layer, and an intermediate layer that is interposed between the two layers to the processing of the following first electrode formation step, first etching step, sacrificial layer formation step, second electrode formation step, sacrificial layer removal step and second etching step. In the first electrode formation step, a movable contact portion is formed on a first part that is processed to produce the movable portion of the first layer of the material substrate. In the first etching step, the first layer is subjected to anisotropic etching as far as the intermediate layer via a mask pattern that masks the first part and a second part that is linked to the first part and processed to produce the fixing portion of the first layer. In the sacrificial layer formation step, a sacrificial layer that has a prescribed opening for exposing a join region of the second part is formed. In the second electrode formation step, a fixed contact electrode that comprises a part facing the movable contact portion via the sacrificial layer and which is joined to the second part in the join region is formed by means of electroplating or electroless plating, for example. The sacrificial layer is removed in the sacrificial layer removal step. In the second etching step, the intermediate layer that is interposed between the second layer constituting the base substrate and the first part is removed by etching. The sacrificial layer removal step and second etching step can be performed by wet etching using a prescribed etchant and can be performed continuously in a substantially single step.

According to this method, a microswitching element comprising a pair of fixed contact electrodes can be fabricated without undertaking the above-described series of steps pertaining to the conventional microswitching element X6 of forming a pair of fixed contact electrodes on the base substrate through patterning, forming a sacrificial layer to cover the fixed contact electrodes and forming an extension portion or arm portion on the sacrificial layer. As a result, a thickness that is sufficient to implement the desired low resistance can be established for the pair of fixed contact electrodes of the microswitching element obtained by means of this method.

Further, according to this method, the microswitching element of the present invention can be suitably fabricated by avoiding detachment of the movable contact portion. When a precious metal with a large ionization tendency (gold, for example) is preferably adopted as the constituent material of the movable contact portion and a prescribed silicon material is preferably adopted as the constituent material of the movable portion, the silicon has a larger ionization tendency than the precious metal. As a result, in the above sacrificial layer removal step and second etching step, in the case of the movable contact portion and the movable portion at which the movable contact portion is joined, the local cell reaction in the etchant (electrolyte solution) advances and part of the movable portion melts. However, in the sacrificial layer removal step and second etching step in the formation of this microswitching element, the movable portion is linked to the fixing portion instead of being isolated. Therefore, the movable portion and whole of the fixing portion act as one pole in the local cell reaction (the movable contact portion acts as the other pole) and it is possible to adequately suppress the amount of solution per unit area of the movable portion. Supposing that the movable portion is isolated instead of being linked to the fixing portion, the solution amount per unit area of the movable portion easily becomes excessive. When the solution amount is excessive, the point of the movable portion at which the movable contact portion is joined becomes highly porous (corroded) and all or part of the movable contact portion becomes detached from the movable portion. However, in the fabrication process of this microswitching element, the solution amount can be suppressed and therefore this detachment phenomenon can be avoided.

As detailed above, the microswitching element of the present invention is adapted to a reduction of insertion loss and can be suitably fabricated.

This microswitching element preferably further comprises a first drive electrode that is provided over the movable portion and fixing portion on the side opposite the base substrate and a second drive electrode that comprises a part facing the first drive electrode and is joined to the fixing portion. This microswitching element can comprise such an electrostatic drive mechanism.

This microswitching element preferably further comprises a first drive electrode that is provided on the side opposite the base substrate and over the movable portion and the fixing portion; a piezoelectric film that is provided on the first drive electrode; and a second drive electrode that is provided on the piezoelectric film. This microswitching element can comprise a piezoelectric drive mechanism of this kind.

The slit preferably comprises a part that extends along the part on the fixing portion of the first drive electrode. When there is a desire to minimize the possibility of leakage to the fixing portion and base substrate of the high-frequency signal that passes through the movable contact portion on account of the reduction of the insertion loss of the switching element, this constitution is suitable in order to suppress leakage of this high frequency signal.

This microswitching element preferably further comprises a slit that comprises a part that extends along the point of the fixing portion at which the fixed contact electrode is joined and which comprises a pair of closed ends. When there is a desire to minimize the possibility of leakage to the fixing portion and base substrate of the high-frequency signal that passes through the fixed contact electrode on account of the reduction of the insertion loss of the switching element, this constitution is suitable in order to suppress this high frequency signal. Further, when a precious metal with a large ionization tendency (gold, for example) is preferably adopted as the constituent material of the fixed contact electrode and a prescribed silicon material is preferably adopted as the constituent material of the fixing portion, silicon has a larger ionization tendency than the precious metal. As a result, in the above sacrificial layer removal step and second etching step, in the case of the fixed contact electrode and the fixing portion to which the fixed contact electrode is joined, part of the fixing portion melts as the local cell reaction in the etchant (electrolyte solution) advances. However, in the sacrificial layer removal step and second etching step in the formation of a microswitching element that adopts this constitution, the point of the fixing portion at which the fixed contact electrode is joined is linked to another point of the fixing portion instead of being isolated. Therefore, the movable portion and the whole of the fixing portion act as one pole in the local cell reaction (the fixed contact electrode acts as the other pole) and it is possible to sufficiently suppress the solution amount per unit area at the point of the fixing portion where the fixed contact electrode is joined. Supposing that the point of the fixing portion at which the fixed contact electrode is joined is isolated instead of being linked to another point of the fixing portion, the solution amount per unit area of the join location easily becomes excessive. When the solution amount is excessive, the point of the fixing portion at which the fixed contact electrode is joined becomes highly porous (corroded) and all or part of the fixed contact electrode becomes detached from the movable portion. However, in the fabrication process of this microswitching element that adopts this constitution, the solution amount can be suppressed and therefore this detachment phenomenon can be avoided.

The part located between the pair of closed ends of the slit of the fixing portion is detached from the base substrate. Such a constitution is preferable in order to suppress leakage to the base substrate of the high frequency signal. The separation distance between the closed ends of the pair of slits is preferably at or below 50 μm. This constitution is suitable in order to suppress leakage of a high frequency signal to the fixing portion and base substrate during element driving while suppressing the solution amount of the constituent material of the movable portion and fixing portion in the process of forming this microswitching element.

The movable contact portion and fixing contact electrode may preferably contain a metal selected from among the group consisting of gold, platinum, palladium, and ruthenium. The movable contact portion and fixed contact electrode preferably consist of a precious metal that does not readily oxidize.

The movable portion and fixing portion preferably consist of a silicon material with a low resistivity or 1000 Ω· cm or more or an N-type silicon material. This constitution is suitable in order to suppress the solution amount of the constituent material of the movable portion and fixing portion in the process of forming this microswitching element.

The movable portion preferably comprises a recess on the opposite side from the base substrate and the movable contact portion preferably comprises a protrusion that protrudes into the recess. Such a constitution is suitable in order to prevent detachment of the movable contact portion from the movable portion.

DESCRIPTION OF THE PREFERRED EMBODIMENTS

Figure 1:
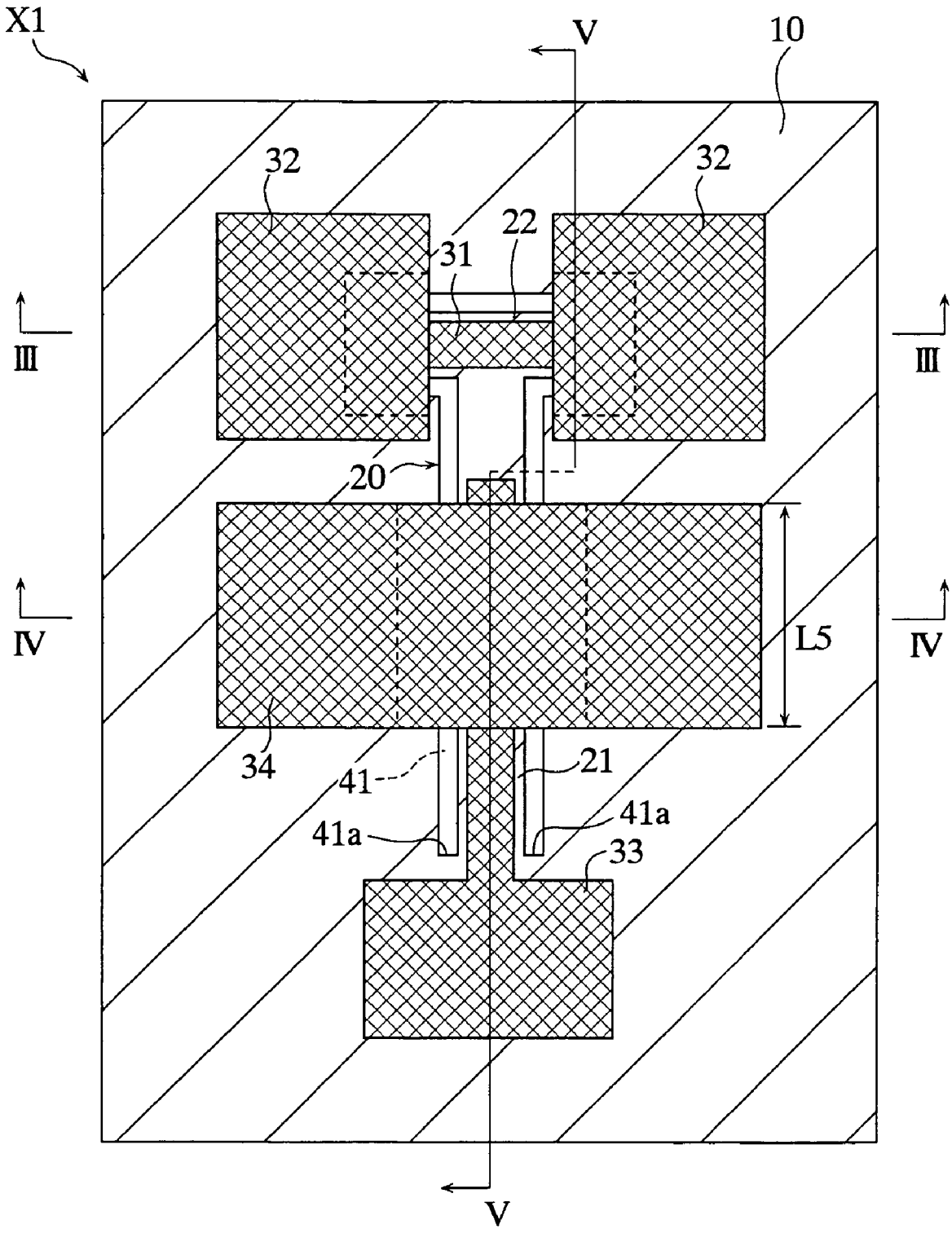
FIG. 1 is a planar view of a microswitching element according to a first embodiment of the present invention.
Figure 2:
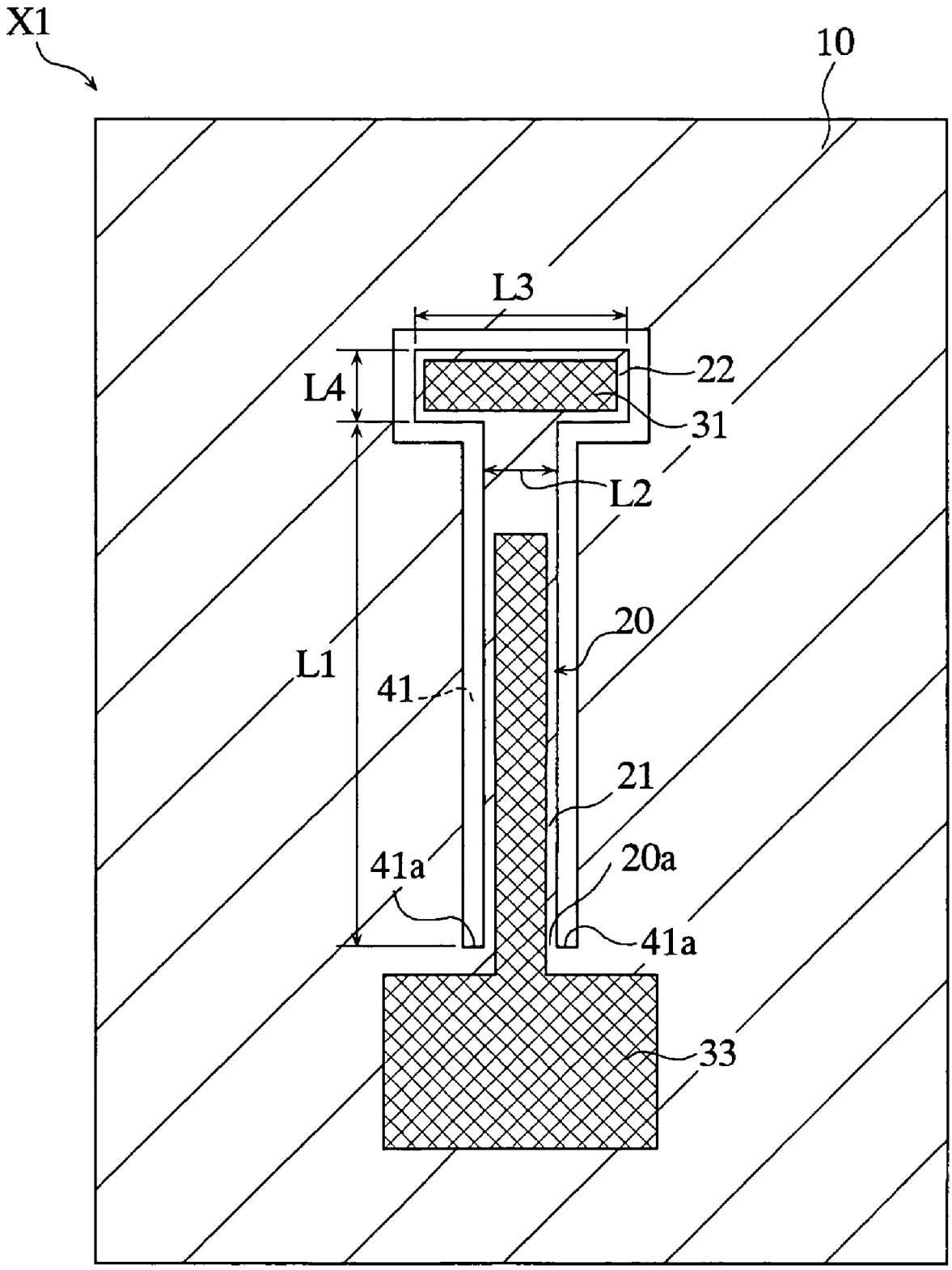
FIG. 2 is a planar view in which part of the microswitching element in FIG. 1 has been omitted.
Figure 3:
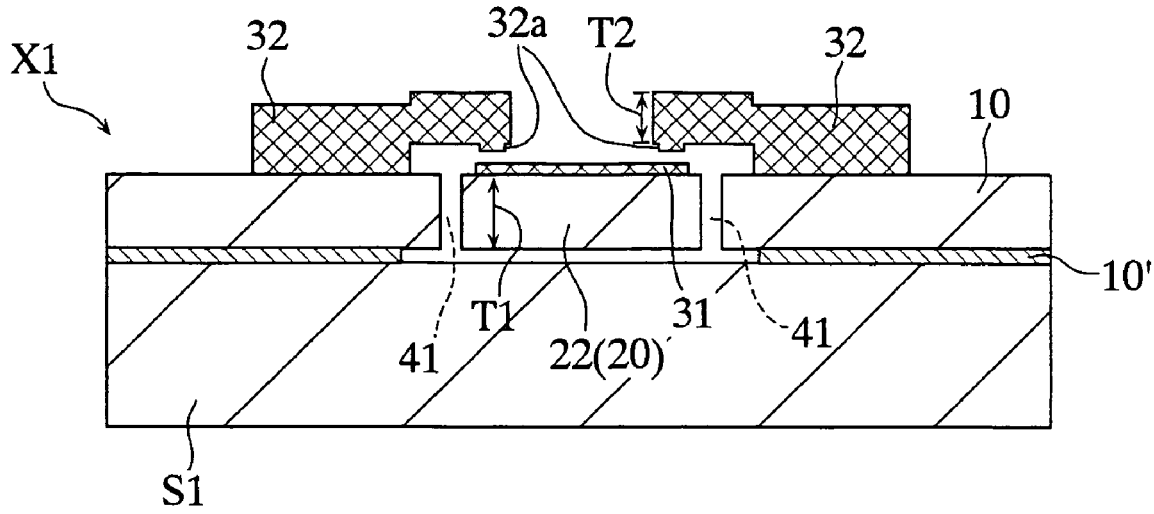
FIG. 3 is a cross-sectional view along the line III-III in FIG. 1.
Figure 4:
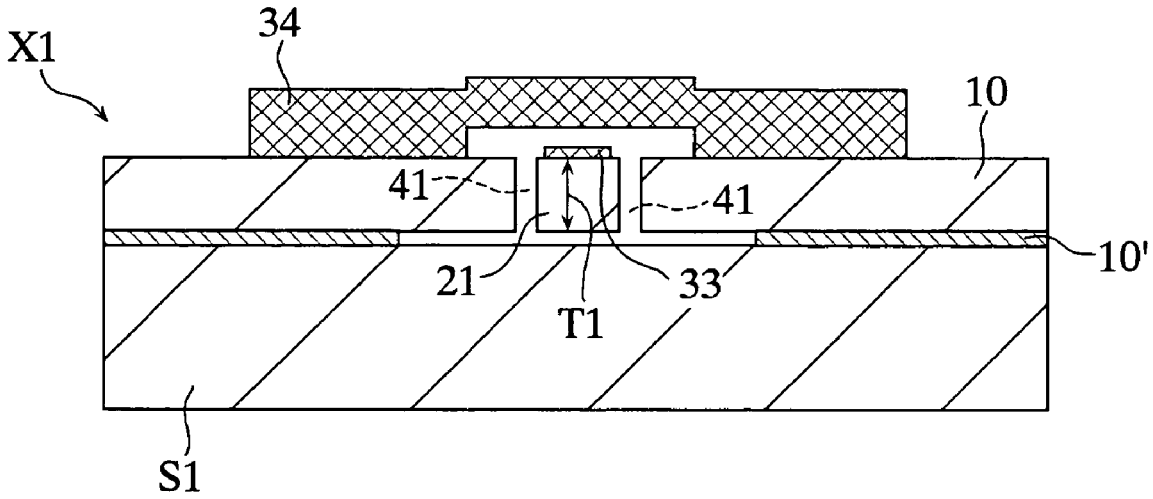
FIG. 4 is a cross-sectional view along the line IV-IV in FIG. 1.
Figure 5:
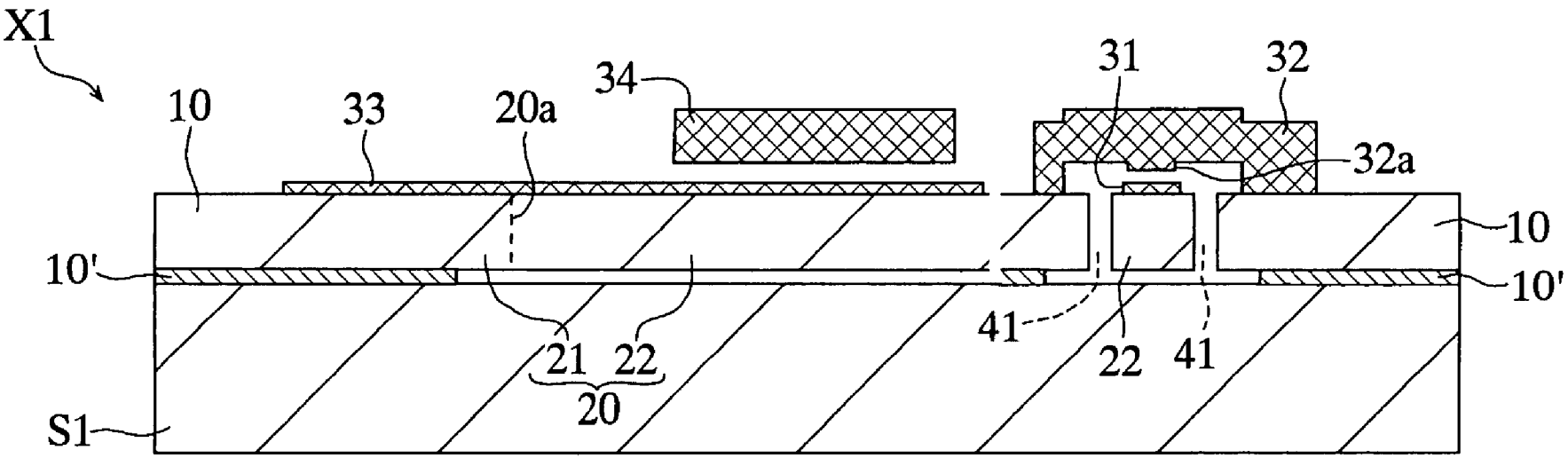
FIG. 5 is a cross-sectional view along the line V-V in FIG. 1.

FIGS. 1 to 5 show a microswitching element X1 according to the first embodiment of the present invention. FIG. 1 is a planar view of the microswitching element X1 and FIG. 2 is a planar view in which apart of the microswitching element X1 is omitted. FIGS. 3 to 5 are each cross-sectional views along the lines III-III, IV-IV, and V-V in FIG. 1.

The microswitching element X1 comprises a base substrate S1, a fixing portion 10, a movable portion 20, a movable contact portion 31, a pair of fixed contact electrodes 32 (omitted from FIG. 2), a drive electrode 33, and a drive electrode 34 (omitted from FIG. 2).

As shown in FIGS. 3 to 5, the fixing portion 10 is joined to the base substrate S1 via a boundary layer 10'. Further, the fixing portion 10 is made of a silicon material such as monocrystalline silicon. The silicon material constituting the fixing portion 10 preferably has a resistivity of 1000 Ω· cm or more and is preferably an N-type material. The boundary layer 10' is made of silicon dioxide, for example.

As shown in FIGS. 2 and 5, for example, the movable portion 20, including a fixed end 20*a* that is fixed to the fixed portion 10, extends along the base substrate S1 and is surrounded by the fixing portion 10 via a slit 41 with a pair of closed ends 41*a*. Further, the movable portion 20 comprises an arm portion 21 and a head portion 22. The thickness T1 shown in FIGS. 3 and 4 of the movable portion 20 is equal to or more than 5 μm, for example. The length L1 shown in FIG. 2 of the arm portion 21 is 400 μm, for example. The length L2 is 30μm, for example. The length L3 shown in FIG. 2 of the head portion 22 is 100μm, for example. The length L4 is 30 μm, for example. The width of the slits 41 is 2 μm, for example. The movable portion 20 is made of monocrystalline silicon, for example. When the movable portion 20 is made of monocrystalline silicon, unreasonable internal stress is not produced in the movable portion 20. In the case of a conventional MEMS switch, thin-film formation technology is sometimes used as the formation method of the movable portion but, in that case, there is the inconvenience that internal stress is produced in the movable portion thus formed and the extension portion itself is improperly deformed as a result of the internal stress. The improper deformation of the movable portion induces deterioration of the characteristics of the MEMS switch, which is undesirable.

The movable contact portion 31 is provided on the head portion 22 of the movable portion 20 as shown in FIG. 2. Each of the pair of fixed contact electrodes 32 is placed on the fixing portion 10 as shown in FIGS. 3 and 5 and comprises a contact portion 32*a* that faces the movable contact portion 31. The thickness T2 of the fixed contact electrode 32 is 5 μm or more, for example. Further, each fixed contact electrode 32 is connected to a prescribed circuit of the switching target via prescribed wiring (not shown). The movable contact portion 31 and pair of fixed contact electrodes 32 are preferably made of a precious metal selected from among gold, platinum, palladium, or ruthenium or of an alloy containing the precious metal cited above.

As shown in FIG. 2, the drive electrode 33 is provided to extend from the arm portion 21 of the movable portion 20 to the fixing portion 10. The drive electrode 34 is provided to cross over the drive electrode 33 with two ends of the drive electrode 34 joined to the fixing portion 10, as shown in FIG. 4. The length L5 shown in FIG. 1 of the drive electrode 34 is 20 μm, for example. Further, the drive electrode 34 is connected to ground via prescribed wiring (not shown). The drive electrodes 33 and 34 are preferably made of a precious metal selected from among gold, platinum, palladium and ruthenium or of an alloy containing the precious metal cited above.

When a prescribed electric potential is supplied to the drive electrode 33 of a microswitching element X1 with this constitution, an electrostatic force of attraction is produced between the drive electrodes 33 and 34. As a result, the movable portion 20 is elastically deformed to a position where the movable contact portion 31 touches the pair of fixed contact electrodes 32 and the contact portion 32*a*. Thus, the closed state of the microswitching element X1 is achieved. In the closed state, the pair of fixed contact electrodes 32 is electrically connected by the movable contact portion 31 and current is allowed to pass between the fixed contact electrodes 32. Thus, the on-state of the high frequency signal, for example, can be achieved.

In the case of the microswitching element X1 in a closed state, when the electrostatic force of attraction acting between the drive electrodes 33 and 34 ceases to exist as a result of termination of the supply of the electric potential to the drive electrode 33; the movable portion 20 returns to the natural state and the movable contact portion 31 is spaced apart from the two fixed contact electrodes 32. Thus, the open state of the microswitching element X1 as shown in FIGS. 3 and 5 is achieved. In the open state, the pair of fixed contact electrodes 32 is electrically isolated and the passage of current between the fixed contact electrodes 32 is prevented. Thus, the off-state of a high frequency signal, for example, can be achieved.

Figures 6A, 6B, 6C, 6D:
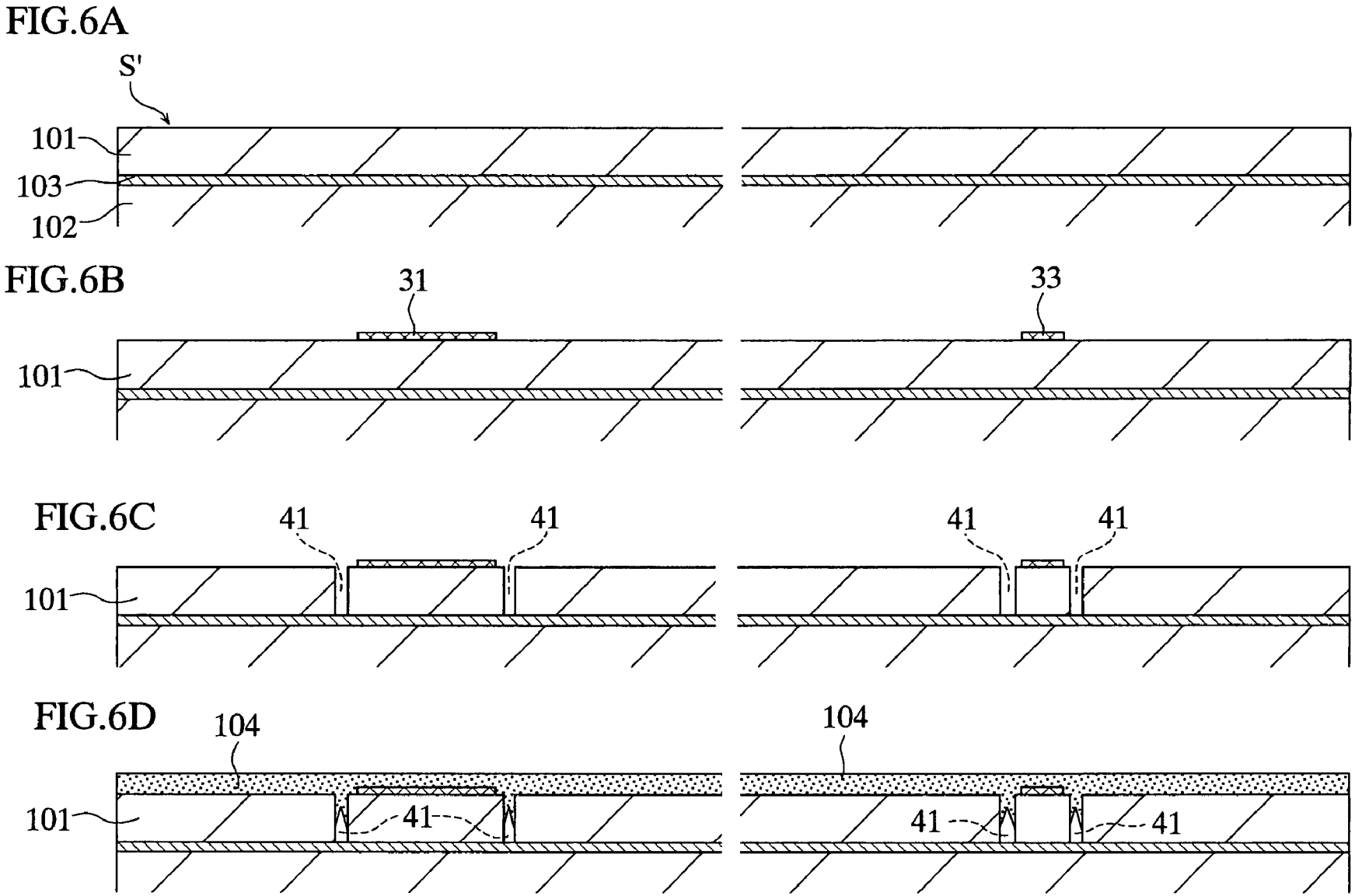
FIG. 6 shows steps of part of the fabrication method of the microswitching element shown in FIG. 1.

FIGS. 6 to 8 show the fabrication method of the microswitching element X1 with the variation in the cross-section corresponding to FIGS. 3 and 4. In the fabrication of the microswitching element X1, the substrate S' shown in FIG. 6A is first prepared. The substrate S' is an SOI (silicon on insulator) substrate and comprises a layered structure consisting of a first layer 101, a second layer 102, and an intermediate layer 103 between the first layer 101 and second layer 102. In this embodiment, for example,the thickness of the first layer 101 is 10 μm, the thickness of the second layer 102 is 400 μm, and the thickness of the intermediate layer 103 is 2 μm. The first layer 101 and second layer 102 are parts that are made of monocrystalline silicon, for example, and which are processed to produce the fixing portion 10 and movable portion 20. The intermediate layer 103 is a part that is made of silicon dioxide, for example, and is processed to produce the boundary layer 10'.

Thereafter, as shown in FIG. 6B, the movable contact portion 31 and drive electrode 33 are formed on the first layer 101 of the substrate S'. Specifically, Cr, for example, is first deposited on the first layer 101 by means of sputtering and then Au, for example, is deposited on the Cr film. The thickness of the Cr film is 50 nm, for example, and the thickness of the Au film is 500 nm, for example. Thereafter, a prescribed resist pattern is formed on the conductor multilayered film by means of photolithography, and then the conductor multilayered film is etched with the resist pattern serving as a mask. Thus, the movable contact portion 31 and drive electrode 33 can be formed through patterning on the first layer 101.

Thereafter, as shown in FIG. 6C, the slit 41 are formed by etching the first layer 101. More specifically, a prescribed resist pattern is formed on the first layer 101 by means of photolithography, and then the first layer 101 is etched with the resist pattern serving as a mask. Ion milling (physical etching with Ar ions, for example) can be adopted as the etching technique.

Thereafter, as shown in FIG. 6D, a sacrificial layer 104 is formed on the first layer 101 of the substrate S' to block the slits 41. Silicon dioxide, for example, can be adopted as the material of the sacrificial layer. Further, plasma CVD or sputtering, for example, can be adopted as the technique for forming the sacrificial layer 104. The thickness of the sacrificial layer 104 is 2 μm, for example. In this step, sacrificial layer material is also deposited on part of the side walls of the slit 41, whereby the slits 41 are blocked.

Figures 7A, 7B, 7C:
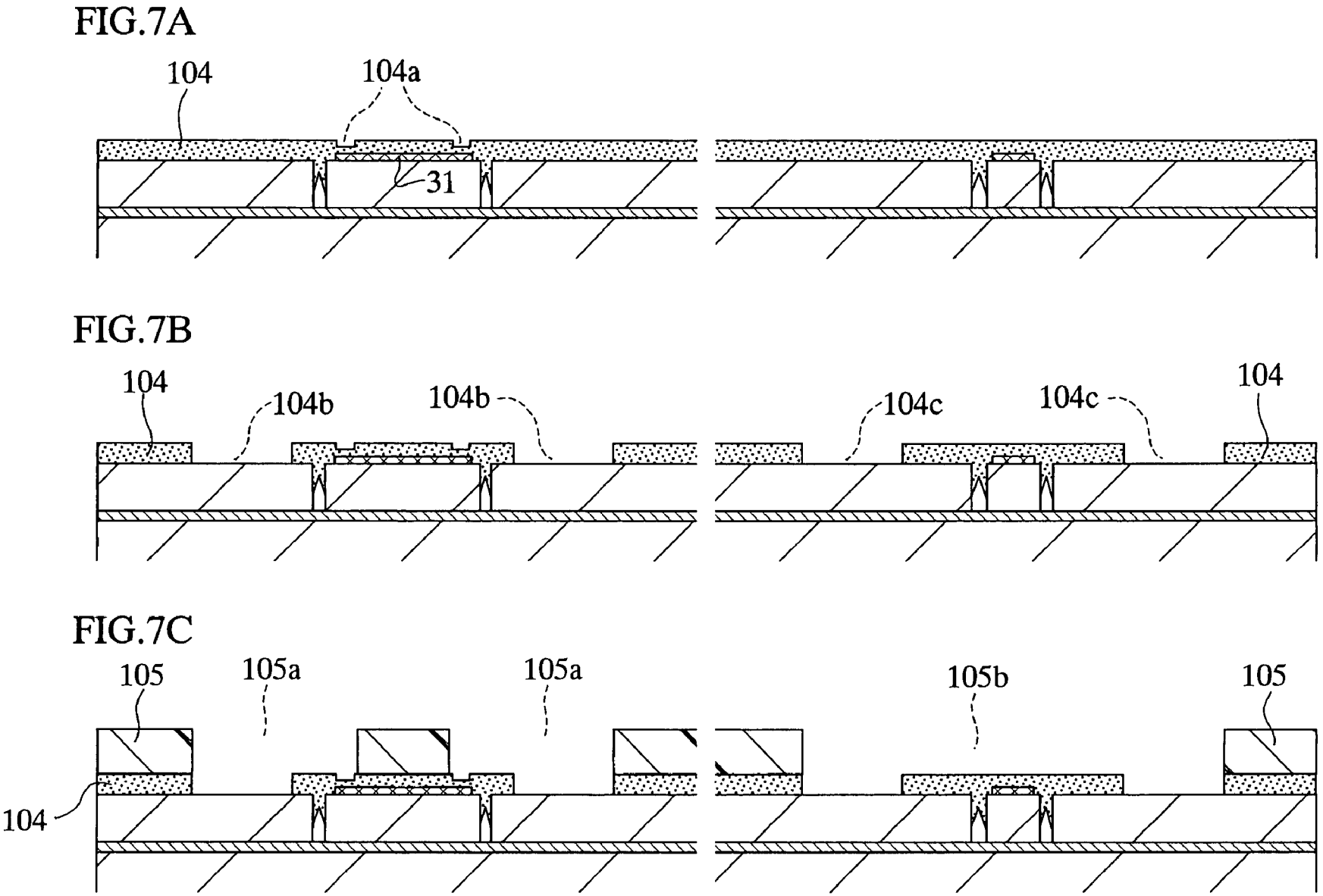
FIG. 7 shows steps succeeding the steps in FIG. 6.

Thereafter, as shown in FIG. 7A, two recesses 104*a* are formed at points of the sacrificial layer 104 that corresponds to the movable contact portion 31. More specifically, a prescribed resist pattern is formed on the sacrificial layer 104 by means of photolithography, and then the sacrificial layer 104 is etched with the resist pattern serving as a mask. Wet etching can be adopted as the etching technique. Each recess 104*a* serves to form the contact portion 32*a* of the fixed contact electrode 32 and has a depth of 1 μm, for example.

Thereafter, as shown in FIG. 7B, openings 104*b* and 104*c* are formed by patterning the sacrificial layer 104. More specifically, a prescribed resist pattern is formed on the sacrificial layer 104 by means of photolithography, and then the sacrificial layer 104 is etched with the resist pattern serving as a mask. Wet etching can be adopted as the etching technique. The opening 104*b* exposes a region of the fixing portion 10 where the fixed contact electrode 32 is joined. The opening 104*c* exposes a region of the fixing portion 10 where the drive electrode 34 is joined.

Thereafter, a current-carrying base film (not illustrated) is formed on the surface of the side of the substrate S' where the sacrificial layer 104 is provided, and then a mask 105 is formed as shown in FIG. 7C. The base film can be formed by depositing Cr with the thickness of 50 nm by means of sputtering, for example, and then depositing Au with the thickness of 500 nm on the Cr. The mask 105 has openings 105*a* corresponding to the pair of fixed contact electrodes 32 and an opening 105*b* that corresponds to the drive electrode 34.

Figure 8A:
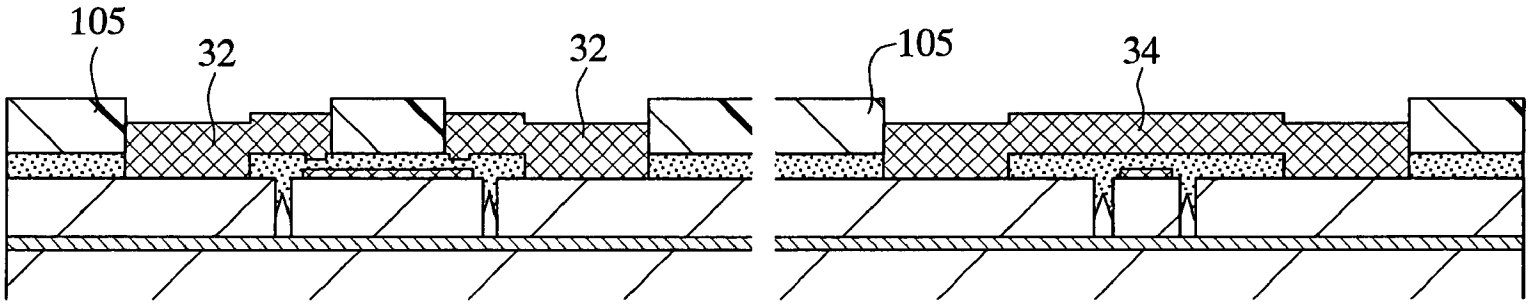
FIG. 8 shows steps that succeed the steps in FIG. 7.

Thereafter, as shown in FIG. 8A, the pair of fixed contact electrodes 32 and the drive electrode 34 are formed. More specifically, gold, for example is grown by means of electroplating on the portions of the base film where the openings 105*a* and 105*b* expose the surface of the base film.

Figure 8B:
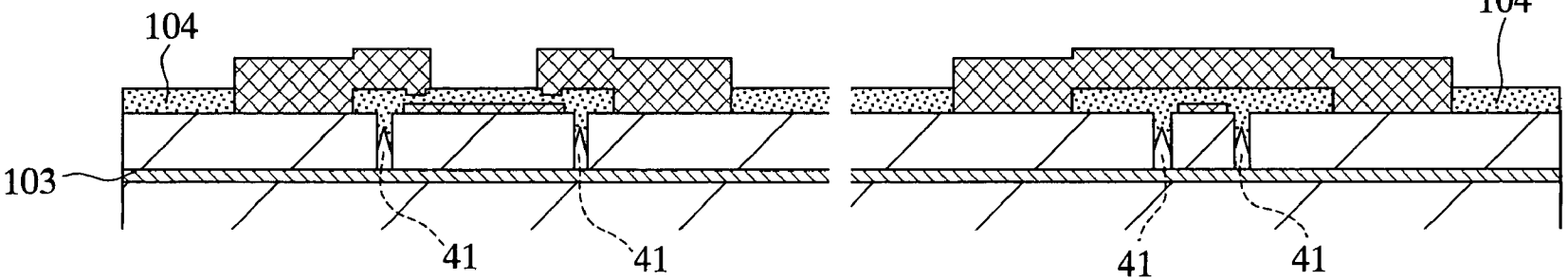

Next, as shown in FIG. 8B, the mask 105 is removed through etching. Thereafter the exposed part of the base film is then removed through etching. Wet etching can be adopted in each of these etching removal steps.

Figure 8C:
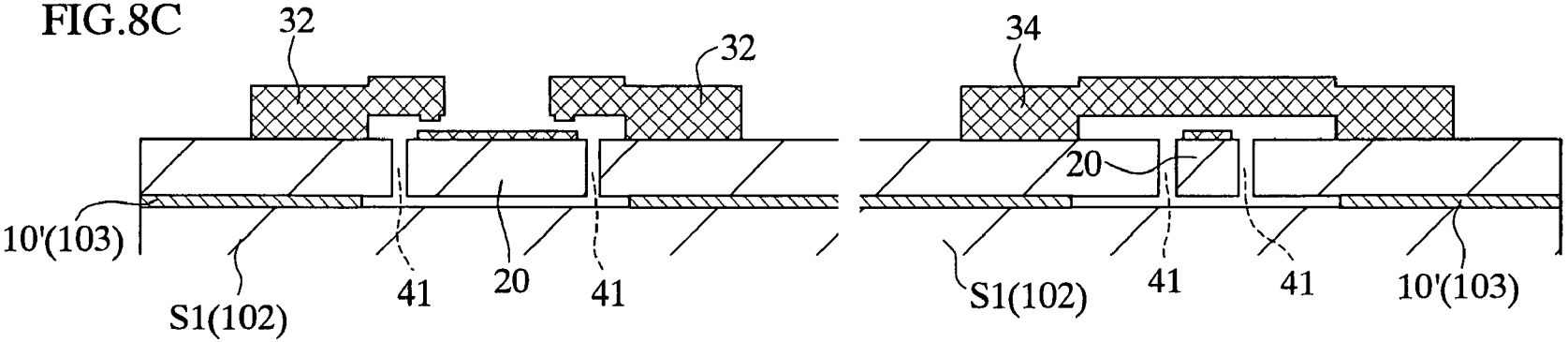

Thereafter, as shown in FIG. 8C, the sacrificial layer 104 and part of the intermediate layer 103 are removed. More specifically, the sacrificial layer 104 and the intermediate layer 103 are wet-etched. Buffered hydrofluoric acid (BHF) can be adopted as the etchant. In this etching process, the sacrificial layer 104 is first removed and then partial removal of the intermediate layer 103 starts from the neighborhood of the slit 41. This etching process ends after a gap has been appropriately formed between the second layer 102 and the whole of the movable portion 20. Thus, the boundary layer 10' remains in the space where the intermediate layer 103 fully occupied before. Further, the second layer 102 constitutes the base substrate S1.

Thereafter, if necessary, part of the base film (Cr film, for example) that is attached to the undersides of the fixed contact electrode 32 and drive electrode 34 is removed through wet etching, and then the whole of the element is dried by means of supercritical drying. With supercritical drying, the sticking phenomenon according to which the movable portion 20 adheres to the base substrate S1 can be avoided.

The microswitching element X1 shown in FIGS. 1 to 5 can be fabricated as detailed herein above. With the above method, the fixed contact electrodes 32 comprising the contact portion 32*a* facing the movable contact portion 31 can be formed thickly on the sacrificial layer 104 by means of plating. As a result, the pair of fixed contact electrodes 32 can be afforded a thickness that is sufficient in order to implement the desired low resistance. A microswitching element X1 of this kind is suitable on account of reducing insertion loss in the closed state.

In the case of the microswitching element X1, the lower surface of the contact portion 32*a* of the fixed contact electrodes 32 (that is, the surface that is in contact with the movable contact portion 31) is very flat and, therefore, an air gap between the movable contact portion 31 and contact portion 32*a* can be provided with high dimensional accuracy. This is because the lower surface of the contact portion 32*a* is the surface on which the plating growth to form the fixed contact electrodes 32 begins. The air gap with high accuracy of dimension is suitable for reducing the insertion loss of the element in a closed state and is suitable for increasing the isolation characteristics of the element in an open state.

Generally, in cases where the dimensional accuracy of the air gap between the movable contact portion and the fixed contact electrodes in the microswitching element is low, inconsistencies in the air gap occur from one element to the next. The longer than the design dimensions the provided air gap is, the harder it is for the movable contact portion to make contact with the fixed contact electrodes in the closing operation of the switching element and therefore insertion loss of the element tends to increase in the closed state. On the other hand, the shorter the provided air gap is than the design dimensions, the smaller the insulation between the movable contact portion and the fixed contact electrodes in the open state of the switching element, and therefore, there is a tendency for the isolation characteristics of the element to deteriorate. Plating can control the thickness of the film less precisely than sputtering and CVD and, therefore, the growth end face of a thick plating film has relatively large undulations and is not very flat and the formation positional accuracy of the growth end face is relatively low. As a result, in cases where the growth end face of the plating film is used as a contact target face of the movable contact portion while the fixed contact electrodes in the microswitching element are constituted by means of a thick plating film, the dimensional accuracy of the air gap between the movable contact portion and the fixed contact electrodes is low and, therefore, inconsistencies in the air gap occur from one element to the next. On the other hand, in the case of the microswitching element X1, because the lower surface of the contact portion 32*a* of the fixed contact electrodes 32 is the initial plating growth end face, the lower surface is very flat and, therefore, the air gap between the movable contact portion 31 and the contact portion 32*a* can be provided with high dimensional accuracy.

In the wet etching step described above with reference to FIG. 8C, detachment of the movable contact portion 31, the fixed contact electrodes 32, and the drive electrodes 33 and 34 can be avoided. A precious metal with a large ionization tendency (gold, for example) is adopted as described above as the constituent material for the movable contact portion 31, fixed contact electrodes 32, and drive electrodes 33 and 34, and silicon material is adopted as the constituent material of the first layer 101 (fixing portion 10, movable portion 20) of the substrate S' The silicon has a larger ionization tendency than the precious metal. That means that part of the first layer 101 may melt because, in the wet etching step mentioned earlier with reference to FIG. 8C, local cell reaction is caused in the etchant (electrolyte solution) by the movable contact portion 31, fixed contact electrodes 32, drive electrodes 33 and 34, and the first layer 101 which the parts cited above are joined to. However, in the wet etching step described above with reference to FIG. 8C, any point of the fixing portion 10 is linked to another point of the fixing portion 10 instead of being isolated. The movable portion 20 is also linked to the fixing portion 10 instead of being isolated. Therefore, the movable portion 20 and the whole of the fixing portion 10 act as one pole in the local cell reaction and, thus, it is possible to adequately suppress the amount of solution per unit area of the movable portion 20 and fixing portion 10. Supposing that the movable portion 20 is isolated instead of being linked to the fixing portion 10, the solution amount per unit area of the movable portion 20 easily becomes excessive. Further, supposing that the point of the fixing portion 10 where the fixing content electrodes 32 are joined is isolated instead of being linked to another point of the fixing portion 10, the solution amount per unit area at the joining point readily becomes excessive. When the solution amount is excessive, the point of the movable portion 20 at which the movable contact portion 31 is joined, for example, becomes highly porous (corroded) and all or part of the movable contact portion 31 becomes detached from the movable portion 20. In another case, the point of the fixing portion 10 where the fixing contact electrodes 32 are joined is highly porous (corroded) and all or part of the fixed contact electrodes 32 becomes detached from the fixing portion 10. However, in the wet etching step described above with reference to FIG. 8C, the solution amount can be suppressed and therefore this detachment phenomenon can be avoided. As detailed above, the microswitching element X1 can be suitably fabricated by avoiding detachment of the movable contact portion 31, fixed contact electrodes 32, and drive electrodes 33 and 34.

Figure 9:
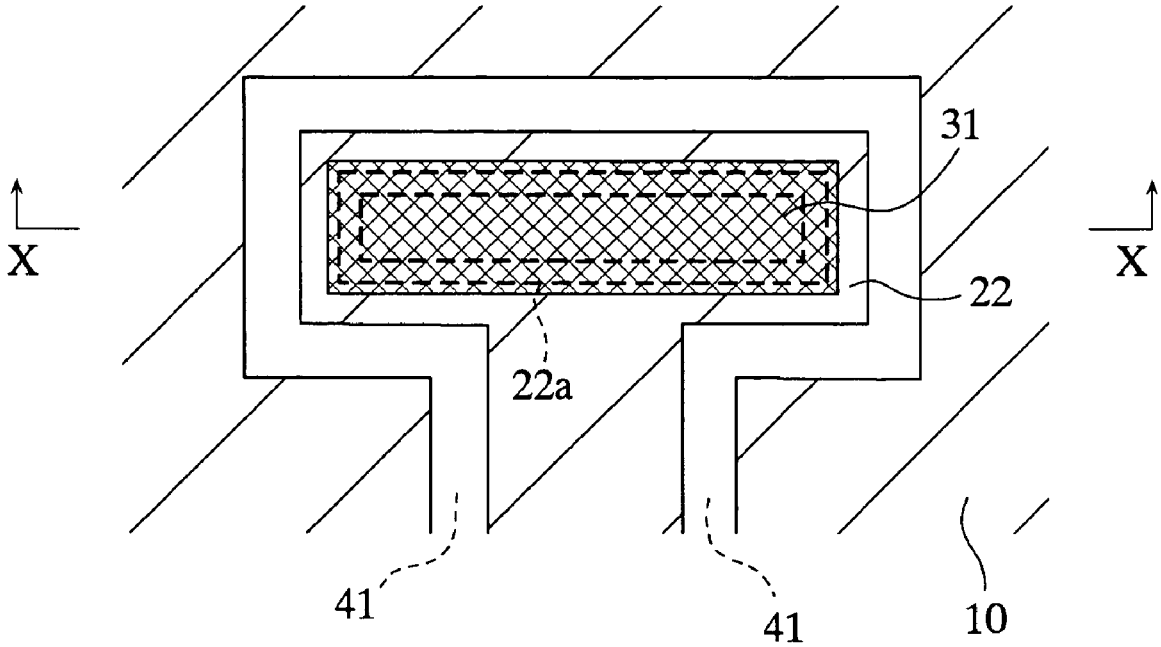
FIG. 9 is a planar view of a modified example of the microswitching element according to the first embodiment.
Figure 10:
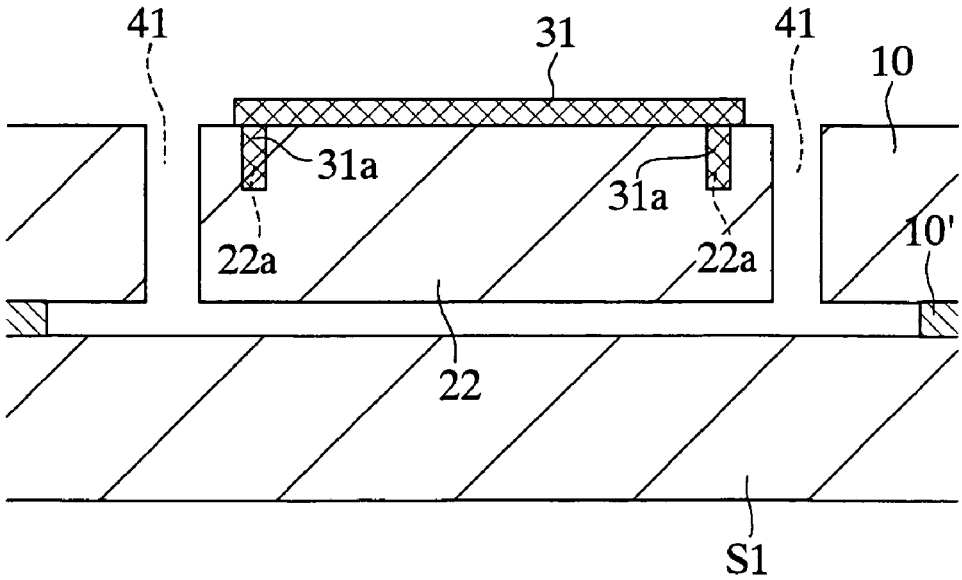
FIG. 10 is a cross-sectional view along the line X-X in FIG. 9.

In the case of the microswitching element X1, as shown in FIGS. 9 and 10, the head portion 22 of the movable portion 20 may comprise a groove 22*a* and the movable contact portion 31 may comprise a protrusion 31*a* that protrudes toward the groove 22*a*. Such a constitution is suitable for preventing detachment of the movable contact portion 31 from the movable portion 20. In cases where this constitution is adopted, in the fabrication process of the microswitching element X1, the groove 22*a* is formed by means of etching, for example, at a prescribed point on the first layer 101 of the substrate S' prior to forming the movable contact portion 31 as detailed earlier with reference to FIG. 6B. Thereafter, the movable contact portion 31 is formed through patterning on the first layer 101 while covering the groove 22*a* by means of a technique that is similar to that mentioned earlier with reference to FIG. 6B.

In the fabrication process of the microswitching element X1, in the wet etching step described above with reference to FIG. 8C, when the local cell reaction in the etchant advances and part of the first layer 101 melts, the constitution shown in FIGS. 9 and 10 that makes it possible to secure a wide contact area between the movable portion 20 and the movable contact portion 31 is suitable in order to prevent detachment of the movable contact portion 31 from the movable portion 20. Further, when the melting in the wet etching step described above with reference to FIG. 8C advances detachment of metal pieces with a small area readily occurs and, therefore, the adoption of the constitution shown in FIGS. 9 and 10 is preferable for the form of the join of the movable contact portion 31 that corresponds to a functional metal piece with a minimum area in the microswitching element X1.

Figure 11:
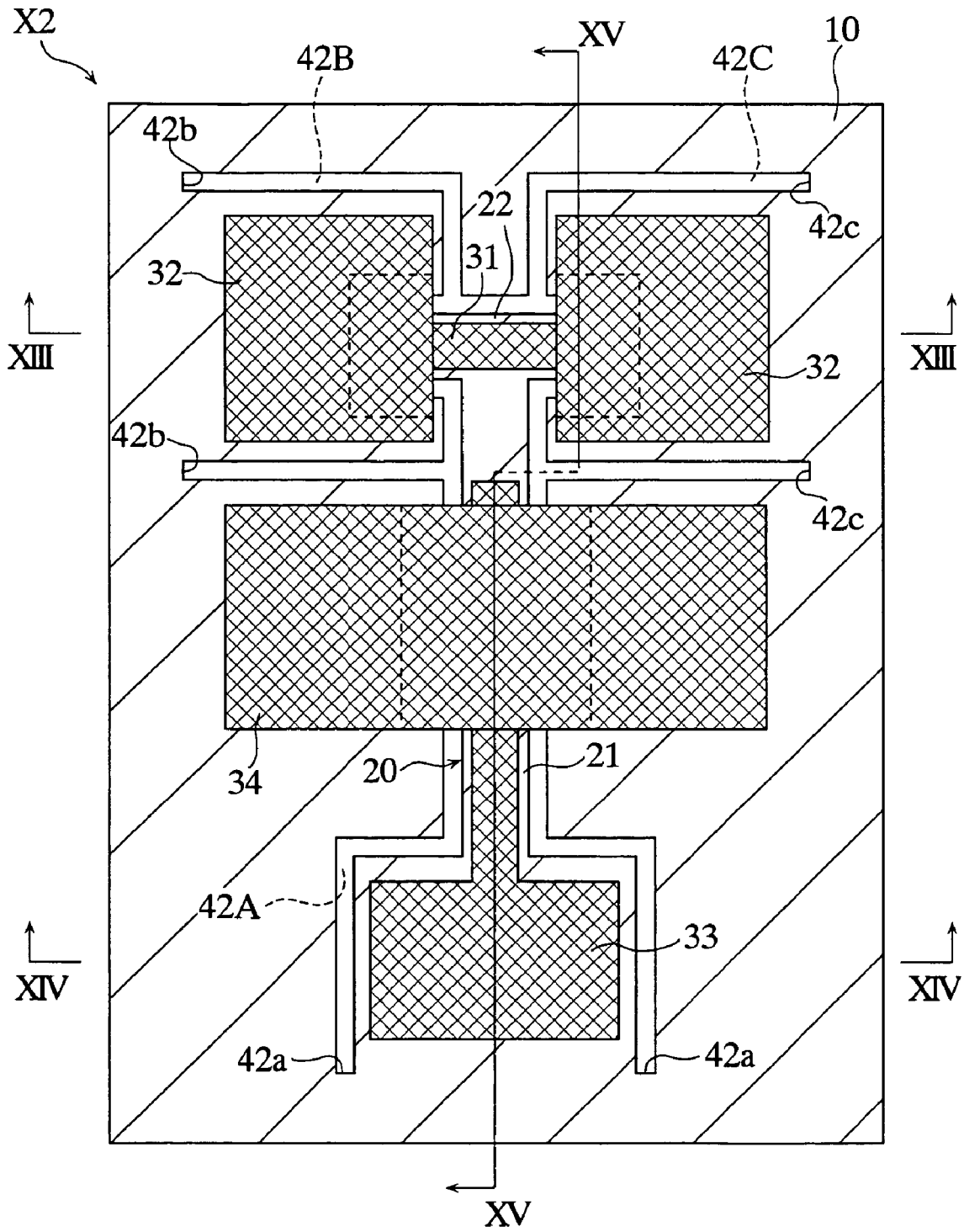
FIG. 11 is a planar view of the microswitching element according to a second embodiment of the present invention.
Figure 12:
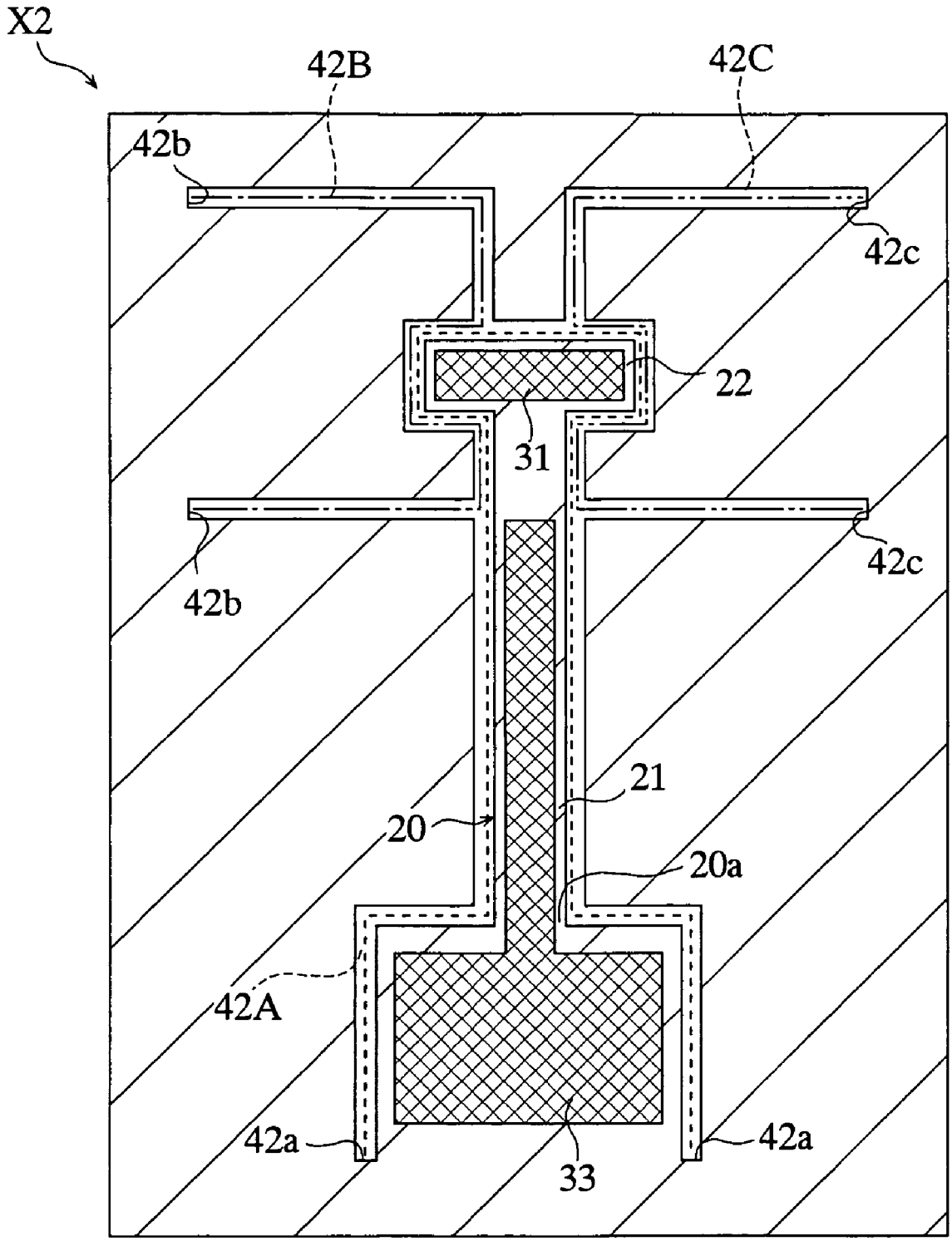
FIG. 12 is a planar view in which part of the microswitching element in FIG. 11 is omitted.
Figure 13:
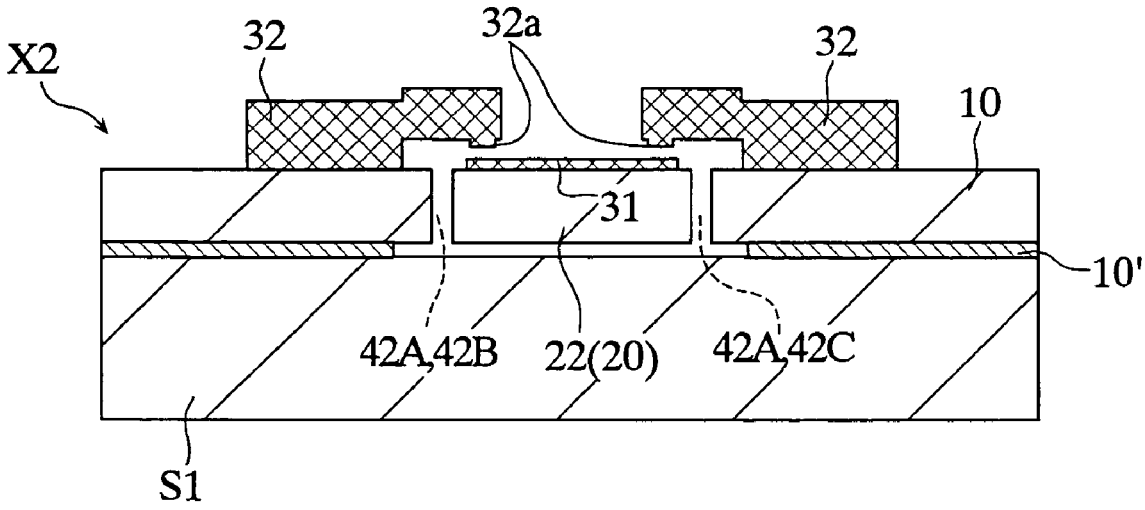
FIG. 13 is a cross-sectional view along the line XIII-XIII in FIG. 11.
Figure 14:
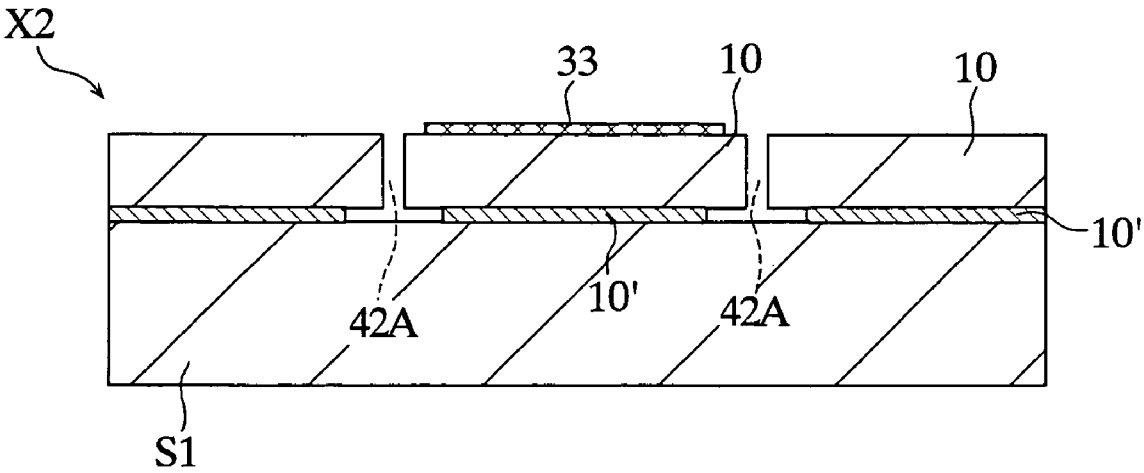
FIG. 14 is a cross-sectional view along the line XIV-XIV of FIG. 11.
Figure 15:
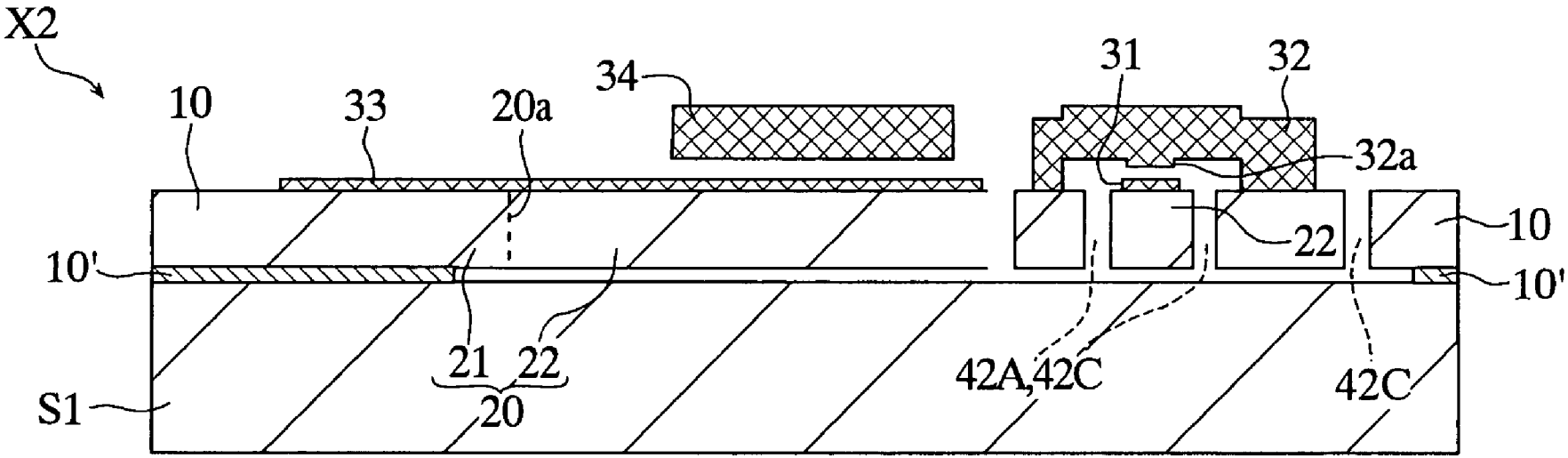
FIG. 15 is a cross-sectional view along the line XV-XV in FIG. 11.

FIGS. 11 to 15 show a microswitching element X2 according to the second embodiment of the present invention. FIG. 11 is a planar view of the microswitching element X2 and FIG. 12 is a planar view in which part of the microswitching element X2 is omitted. FIGS. 13 to 15 are cross-sectional views along the lines XIII-XIII, XIV to XIV and XV to XV in FIG. 11 respectively. The microswitching element X2 differs from the microswitching element X1 by virtue of comprising slits 42A, 42B, and 42C instead of the slit 41.

The slit 42A comprises a part that extends between the movable portion 20 and fixing portion 10 and a part that extends along the part of the drive electrode 33 which is on the fixing portion 10 and comprises a pair of closed ends 42*a*. FIG. 12 has a dotted line extending along the slit 42A for the sake of clarification.

The slit 42B comprises a part that extends along the portion at which one fixed contact electrode 32 is joined to the fixing portion 10 and also comprises a pair of closed ends 42*b*. The slit 42C comprises a part that extends along the point at which the other fixed contact electrode 32 is joined to the fixing portion 10 and comprises a pair of closed ends 42*c*. FIG. 12 has a single-dot chain line that extends along the slit 42B and a double-dot chain line that extends along the slit 42C for the sake of clarification of the illustration. In this embodiment, part of each of the slits 42B and 42C overlap part of the slit 42A.

When a prescribed electric potential is supplied to the drive electrode 33 of a microswitching element X2 with this constitution, an electrostatic force of attraction is produced between the drive electrodes 33 and 34. As a result, the movable portion 20 is elastically deformed to a position where the movable contact portion 31 contacts the pair of fixed contact electrodes 32 and the contact portion 32*a*. Thus, the closed state of the microswitching element X2 is achieved. In the closed state, the pair of fixed contact electrodes 32 is electrically connected by the movable contact portion 31 and current is allowed to pass between the fixed contact electrodes 32. Thus, the on-state of the high frequency signal, for example, can be achieved. In the case of the microswitching element X2 in which slit 42A, which comprises a part that extends along a part of the drive electrode 33 which is on the fixing portion 10 and slits 42B and 42C, which comprise a part that extends along the point of the fixing portion 10 at which the fixed contact electrodes 32 are joined, are provided, leakage of a high frequency signal to the fixing portion 10 and base substrate S1 is suppressed.

In the case of the microswitching element X2 in the closed state, when the electrostatic force of attraction acting between the drive electrodes 33 and 34 ceases to exist as a result of termination of the supply of the electric potential to the drive electrode 33, the movable portion 20 returns to the natural state and the movable contact portion 31 is spaced apart from the fixed contact electrodes 32. Thus, the open state of the microswitching element X2 as shown in FIGS. 13 and 15 is achieved. In the open state, the pair of fixed contact electrodes 32 is electrically isolated and the passage of current between the fixed contact electrodes 32 is prevented. Thus, the off-state of a high frequency signal, for example, can be achieved.

This kind of microswitching element X2 can be fabricated in the same way as the microswitching element X1 except for the formation of the slits 42A, 42B, and 42C instead of the slit 41. Therefore, in the case of the micro switching element X2, similarly to the microswitching element X1, the pair of fixed contact electrodes 32 can be afforded a thickness that is sufficient in order to implement the desired low resistance. Further, in the case of the microswitching element X2, similarly to the microswitching element X1, the lower surface of the contact portion 32*a* of the fixed contact electrodes 32 (that is, the surface to contact the movable contact portion 31) is very flat and, therefore, an air gap between the movable contact portion 31 and contact portion 32*a* can be provided with high dimensional accuracy. In addition, similarly to the microswitching element X1, the microswitching element X2 can be suitably fabricated by avoiding detachment of the movable contact portion 31, fixed contact electrodes 32, and drive electrodes 33 and 34. This kind of microswitching element X2 is suitable on account of reducing insertion loss in the closed state.

Figure 16:
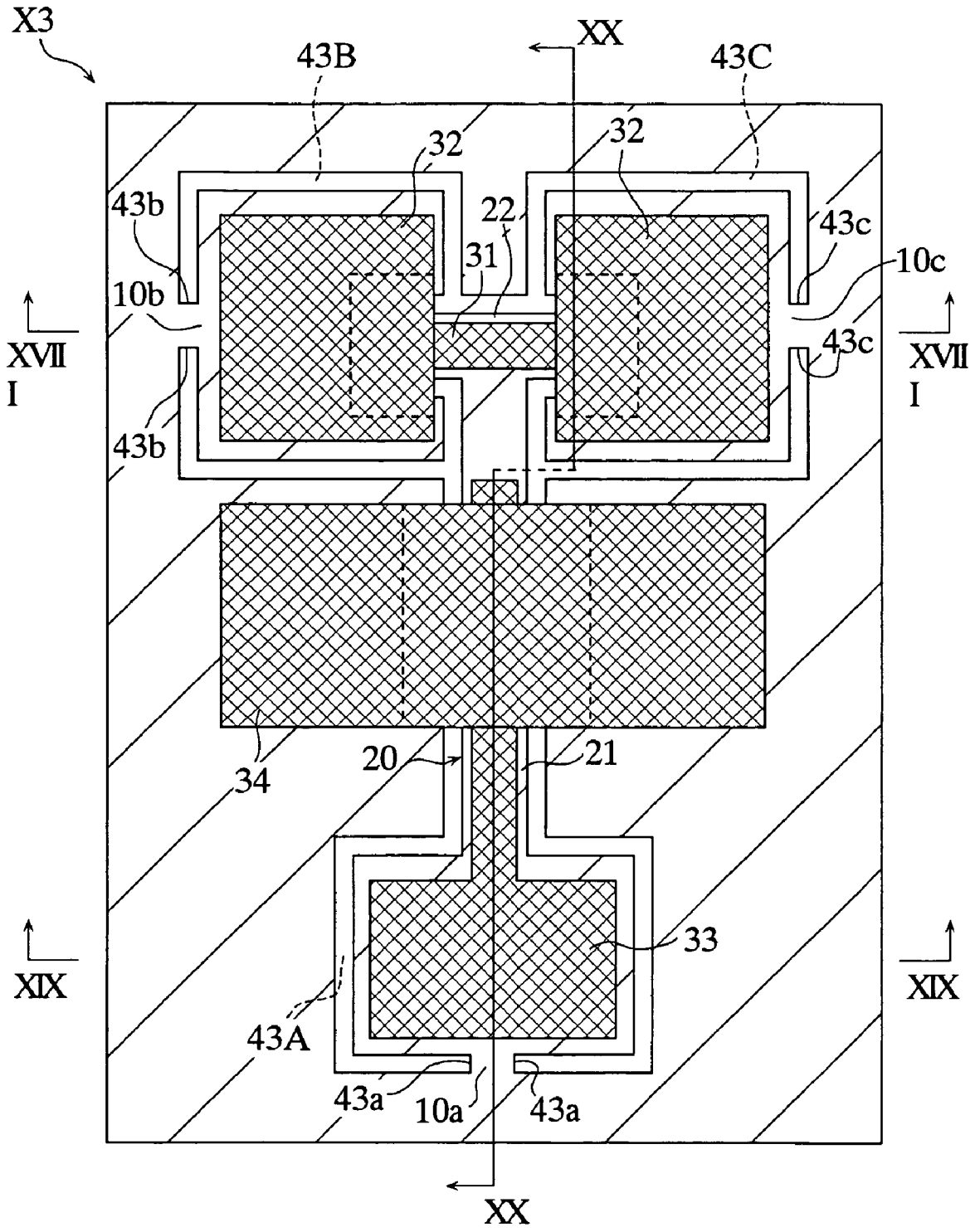
FIG. 16 is a planar view of a microswitching element according to a third embodiment of the present invention.
Figure 17:
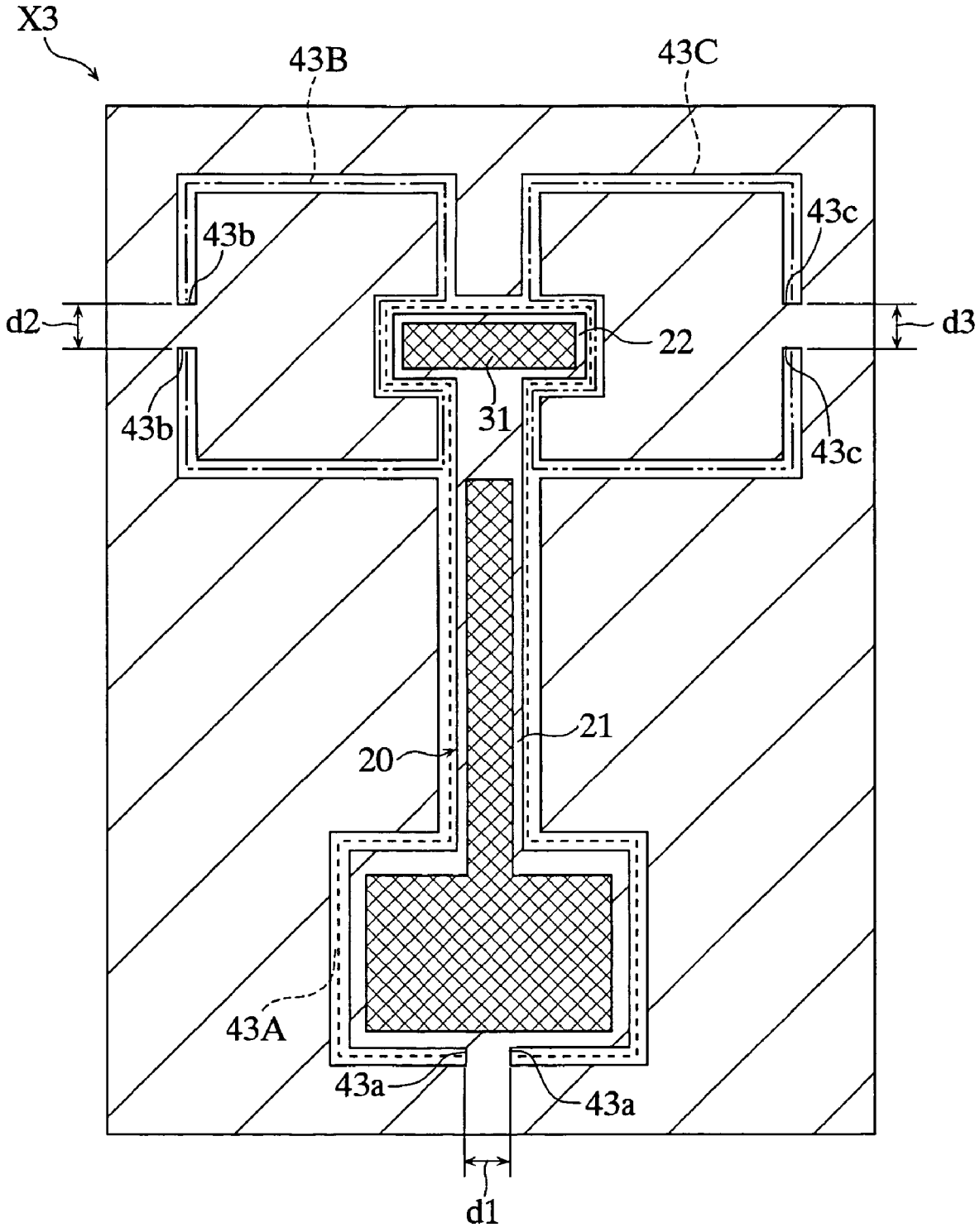
FIG. 17 is a planar view in which part of the microswitching element in FIG. 16 is omitted.
Figure 18:
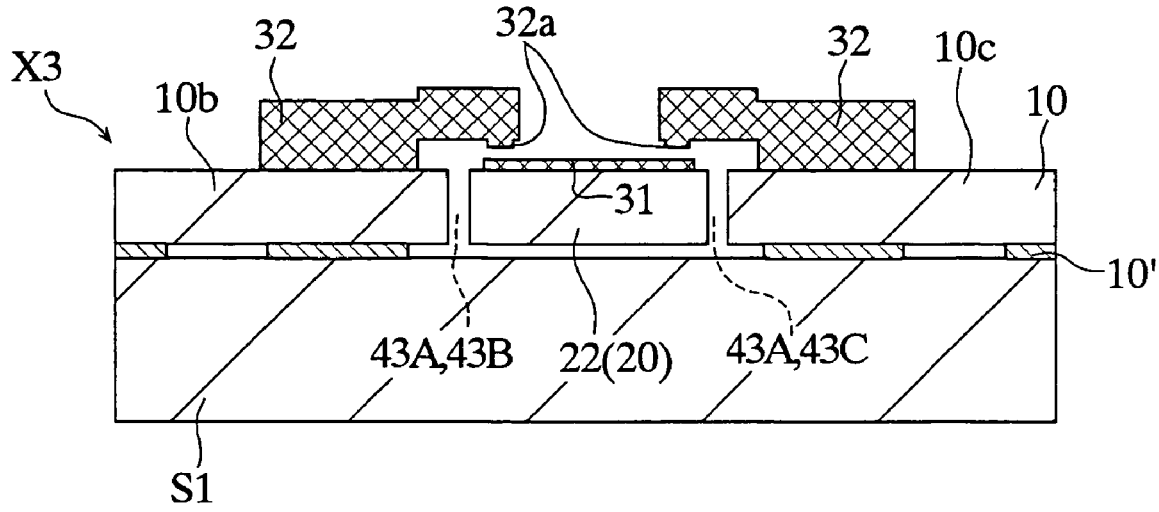
FIG. 18 is a cross-sectional view along the line XVIII-XVIII in FIG. 16.
Figure 19:
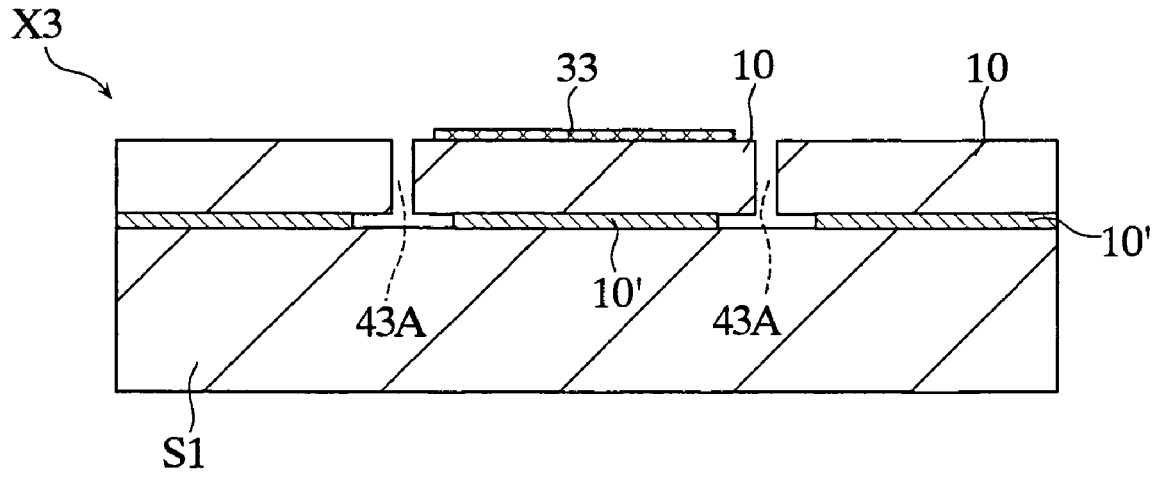
FIG. 19 is a cross-sectional view along the line XIX-XIX in FIG. 16.
Figure 20:
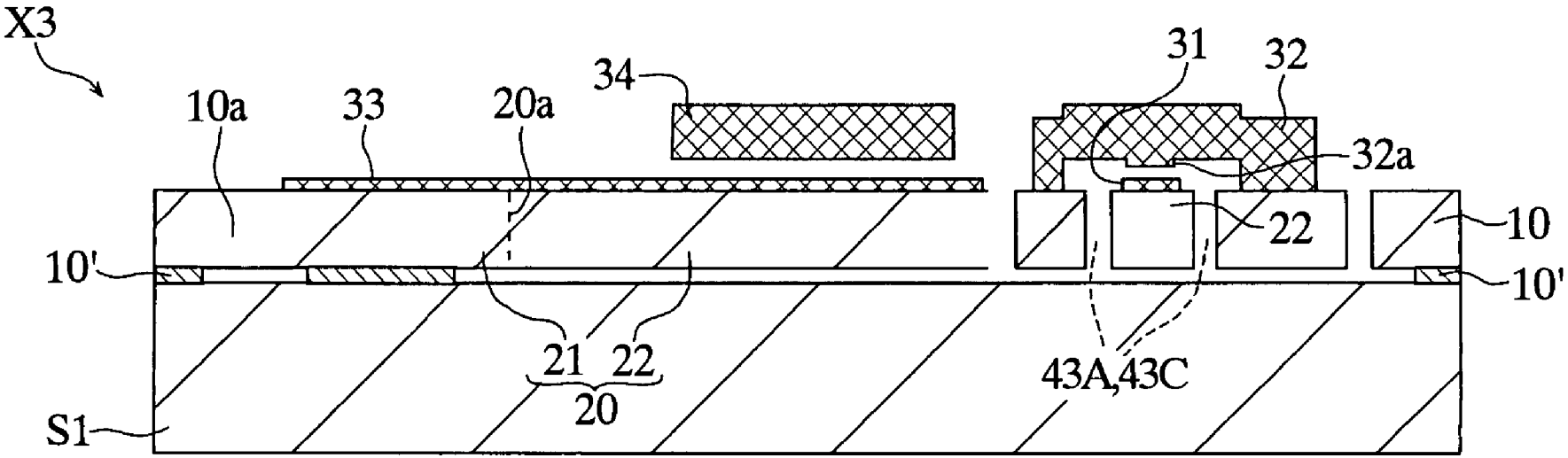
FIG. 20 is a cross-sectional view along the line XX-XX in FIG. 16.

FIGS. 16 to 20 show a microswitching element X3 according to the third embodiment of the present invention. FIG. 16 is a planar view of the microswitching element X3. FIG. 17 is a planar view in which part of the microswitching element X3 is omitted. FIGS. 18 to 20 are cross-sectional views along the lines XVIII-XVIII, XIX-XIX, and XX-XX in FIG. 16. The microswitching element X3 differs from the microswitching element X1 in the fact that the microswitching element X3 comprises slits 43A, 43B, and 43C instead of the slit 41.

Slit 43A comprises a part that extends between the movable portion 20 and the fixing portion 10 and a part that extends along the part of the drive electrode 33 which is on the fixing portion 10 and comprises a pair of closed ends 43*a*. FIG. 17 has a dotted line that extends along the slit 43A for the sake of clarifying the illustration. The distance d1 (shown in FIG. 17) between the closed ends 43*a* of the slit 43A is equal to or less than 50 μm. Further, part 10*a*, which is located between the closed ends 43*a* of the fixing portion 10, is spaced apart from the base substrate S1 as shown in FIG. 20.

Slit 43B comprises a part that extends along the point at which one fixed contact electrode 32 is joined of the fixing portion 10 and a pair of closed ends 43*b*. FIG. 17 has a single-dot chain line that extends along slit 43B for the sake of find illustration. In this embodiment, part of the slit 43B overlaps part of the slit 43A. The distance d2 (shown in FIG. 17) between the closed ends 43*b* of the slit 43B is equal to or less than 50 μm. Furthermore, the part that is located between the closed ends 43*b* of the fixing portion 10 is spaced apart from the base substrate S1 as shown in FIG. 18.

Slit 43C extends along the point where the other fixed contact electrode 32 is joined of the fixing portion 10 and comprises a pair of closed ends 43*c*. FIG. 17 has a double-dotted chain line that extends along the slit 43C for the sake of clarifying the illustration. In this embodiment, part of the slit 43B overlaps part of the slit 43A. The distance d3 (shown in FIG. 17) between the closed ends 43*c* of slit 43C is equal to or less than 50 μm. Furthermore, the part 10*c* that is located between the closed ends 43*c* of the fixing portion 10 is spaced apart from the base substrate S1 as shown in FIG. 18.

When a prescribed electric potential is supplied to the drive electrode 33 of a microswitching element X3 with this constitution, an electrostatic force of attraction is produced between the drive electrodes 33 and 34. As a result, the movable portion 20 is elastically deformed to a position where the movable contact portion 31 contacts the pair of fixed contact electrodes 32 and the contact portion 32*a*. Thus, the closed state of the microswitching element X3 is achieved. In the closed state, the pair of fixed contact electrodes 32 is electrically connected by the movable contact portion 31 and current is allowed to pass between the fixed contact electrodes 32. Thus, the on-state of the high frequency signal, for example, can be achieved. In the case of the microswitching element X3 in which slit 43A, which comprises a part that extends along a part of the drive electrode 33 which is on the fixing portion 10 and the distance between the closed ends 43*a* of which is short, slit 43B, which comprises a part that extends along the point of the fixing portion 10 at which the fixed contact electrodes 32 are joined and of which the distance between the closed ends 43*b* thereof is short, and slit 43C, which comprises a part that extends along the point of the fixing portion 10 at which the fixed contact electrodes 32 are joined and of which the distance between the closed ends 43*c* thereof is short, are provided, leakage of a high frequency signal to the fixing portion 10 and base substrate S1 is suppressed. In addition, a constitution in which part 10*a*, which is located between the closed ends 43*a* of the fixing portion 10, part 10*b* that is located between the closed ends 43*b*, and part 10*c* that is located between the closed ends 43*c* are spaced apart from the base substrate S1 is also conducive to the suppression of the leakage of a high frequency signal.

In the case of the microswitching element X3 in the closed state, when the electrostatic force of attraction acting between the drive electrodes 33 and 34 ceases to exist as a result of termination of the supply of the electric potential to the drive electrode 33, the movable portion 20 returns to the natural state and the movable contact portion 31 is spaced apart from the fixed contact electrodes 32. Thus, the open state of the microswitching element X3 as shown in FIGS. 18 and 20 is achieved. In the open state, the pair of fixed contact electrodes 32 is electrically isolated and the passage of current between the fixed contact electrodes 32 is prevented. Thus, the off-state of a high frequency signal, for example, can be achieved.

This kind of microswitching element X3 can be fabricated in the same way as the microswitching element X1 except for the formation of the slits 43A, 43B, and 43C instead of the slit 41. Therefore, in the case of the microswitching element X3, similarly to the microswitching element X1, the pair of fixed contact electrodes 32 can be afforded a thickness that is sufficient in order to implement the desired low resistance. Further, in the case of the microswitching element X3, similarly to the microswitching element X1, the lower surface of the contact portion 32*a* of the fixed contact electrodes 32 (that is, the surface to contact the movable contact portion 31) is very flat and, therefore, an air gap between the movable contact portion 31 and contact portion 32*a* can be provided with high dimensional accuracy. In addition, similarly to the microswitching element X1, the microswitching element X3 can be suitably fabricated by avoiding detachment of the movable contact portion 31, fixed contact electrodes 32, and drive electrodes 33 and 34. This kind of microswitching element X3 is suitable on account of reducing insertion loss in the closed state.

Figure 21:
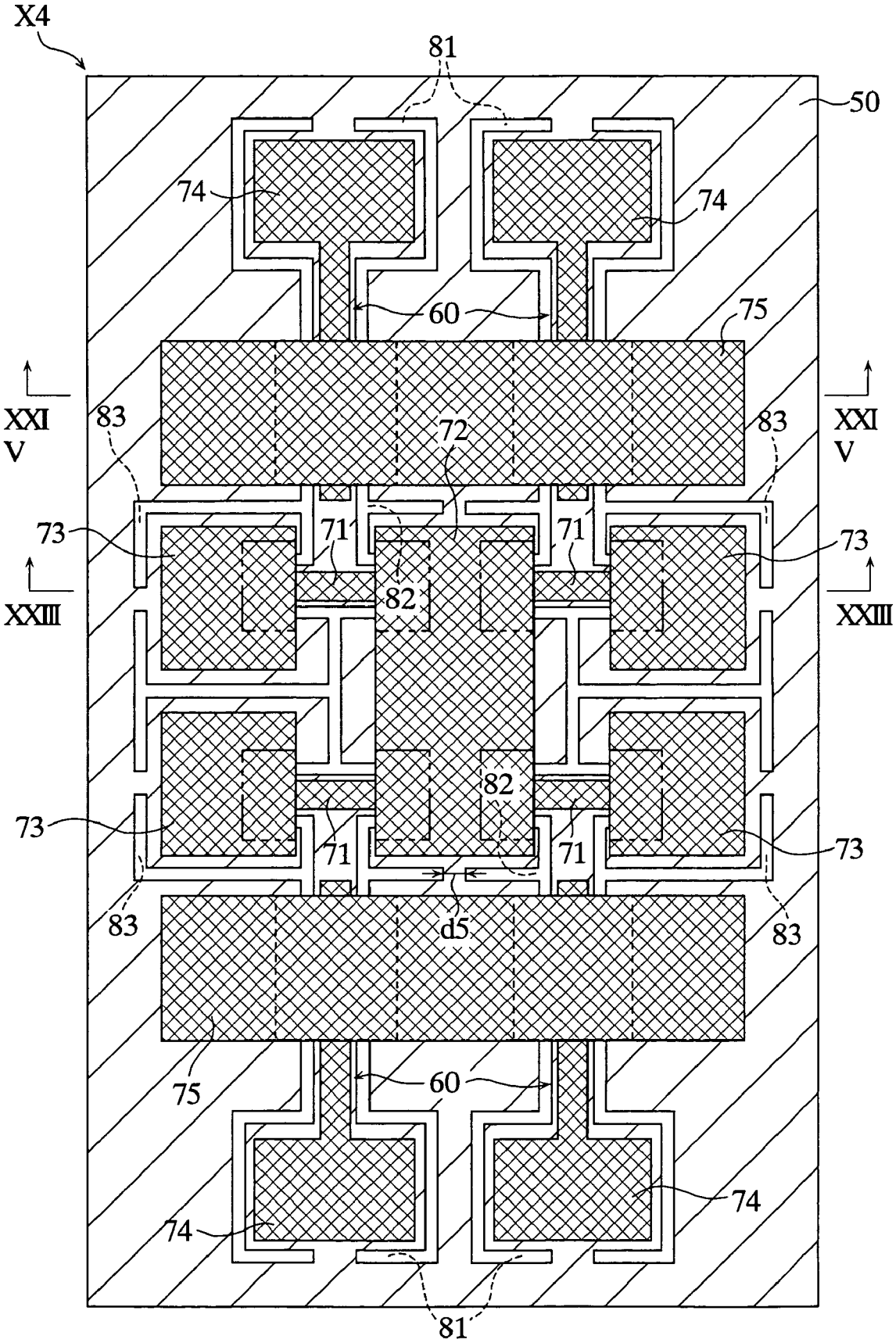
FIG. 21 is a planar view of the microswitching element according to a fourth embodiment of the present invention.
Figure 22:
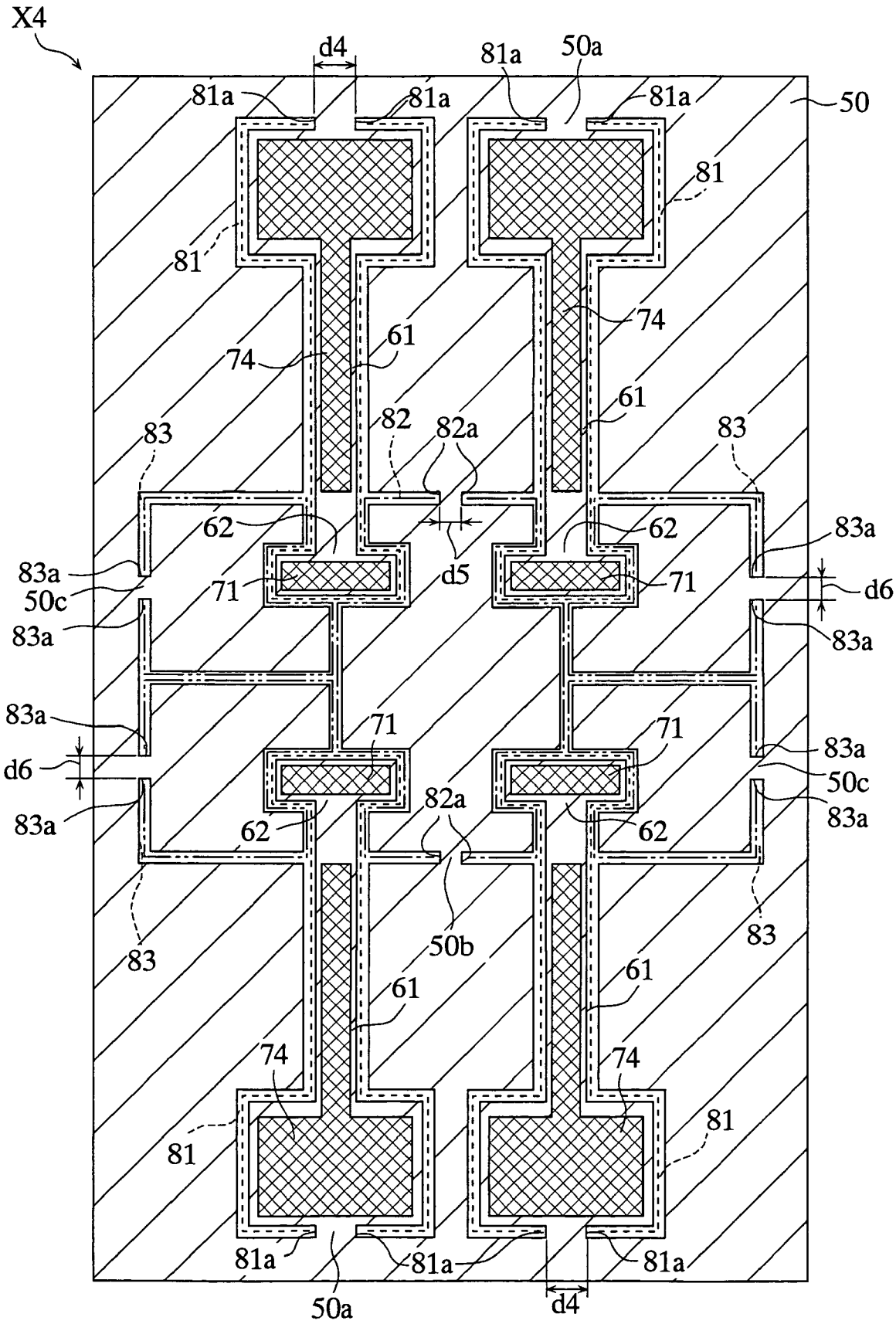
FIG. 22 is a planar view in which part of the microswitching element in FIG. 21 is omitted.
Figure 23:
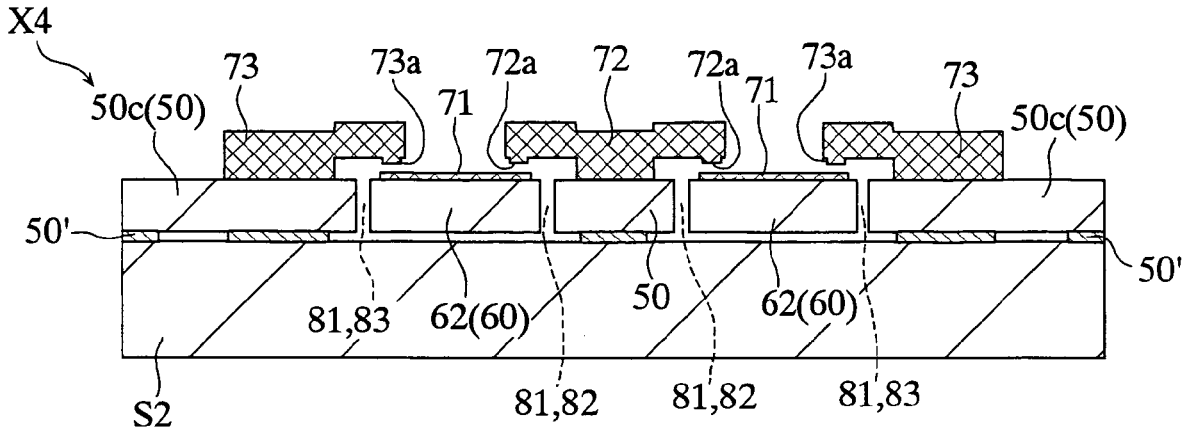
FIG. 23 is a cross-sectional view along the line XXIII-XXIII in FIG. 21.
Figure 24:
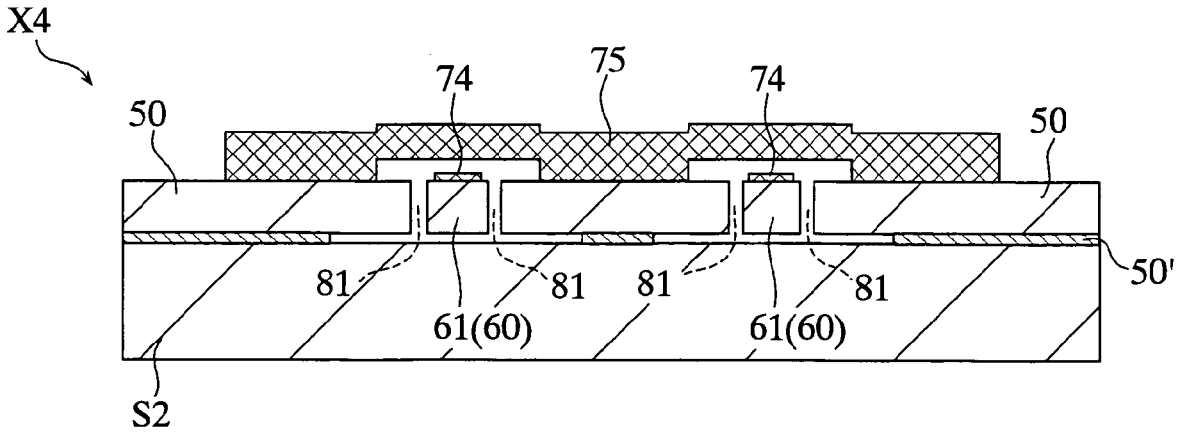
FIG. 24 is a cross-sectional view along the line XXIV-XXIV in FIG. 21.

FIGS. 21 to 24 show a microswitching element X4 according to the fourth embodiment of the present invention. FIG. 21 is a planar view of the microswitching element X4 and FIG. 22 is a planar view in which part of the microswitching element X4 is omitted. FIGS. 23 and 24 are cross-sectional views along the lines XXIII-XXIII and XXIV-XXIV in FIG. 21.

The microswitching element X4 comprises a base substrate S2, a fixing portion 50, four movable portions 60, four movable contact portion 71, a common fixed contact electrode 72 (not shown in FIG. 22), four individual fixed contact electrodes 73 (not shown in FIG. 22), four drive electrodes 74, two drive electrodes 75 (not shown in FIG. 22), four slits 81, two slits 82, and four slits 83 and substantially has a constitution in which four microswitching elements X3 are integrated.

The fixing portion 50 is joined to the base substrate S2 via a boundary layer 50' as shown in FIGS. 23 and 24. Further, the fixing portion 50 is made of a silicon material such as monocrystalline silicon. The silicon material constituting the fixing portion 50 preferably has a resistivity of 1000 Ω· m or more and is preferably an N-type material. The boundary layer 50' is made of silicon dioxide, for example.

The movable portion 60 has a fixed end that is fixed to the fixing portion 50, extends along the base substrate S2, and is surrounded by the fixing portion 50 via the slits 81. Further, the movable portion 60 comprises an arm portion 61 and a head portion 62, as shown in FIG. 22. The remaining constitution of the movable portion 60 is the same as that mentioned earlier with respect to the movable portion 20.

As shown in FIG. 22, the movable contact portion 71 is provided on the head portion 62 of the movable portion 60. The fixed contact electrode 72 is placed on the fixing portion 50 as shown in FIG. 23 and comprises four contact portions 72*a*. Each contact portion 72*a* faces the movable contact portion 71. As shown in FIG. 23, each fixed contact electrode 73 is placed on the fixing portion 50 and comprises a contact portion 73*a* facing the movable contact portion 71. Further, the fixed contact electrodes 72 and 73 are connected to a prescribed circuit constituting the switching target via prescribed wiring (not shown) The movable contact portion 71 and the pair of fixed contact electrodes 72 are preferably made of a precious metal that is selected from among gold, platinum, palladium, or ruthenium, or an alloy containing the precious metal cited above.

As shown in FIG. 22, the drive electrode 74 extends from the arm portion 61 of the movable portion 60 to the fixing portion 50. As shown in FIG. 24, the drive electrode 75 is placed to cross over the two drive electrodes 74 with the two ends and the center of the drive electrode 75 joined to the fixing portion 50. Further, the drive electrode 75 is connected to ground via prescribed wiring (not shown). Drive electrodes 74 and 75 are preferably made of a precious metal that is selected from among gold, platinum, palladium, and ruthenium or of an alloy containing the precious metal cited above.

Each slit 81 comprises a part that extends between the movable portion 60 and the fixing portion 50 and a part that extends along the part of the drive electrode 74 which is on the fixing portion 50, and also comprises a pair of closed ends 81*a*. FIG. 22 has a dotted line that extends along the slit 81 for the sake of clarifying the illustration. The distance d4 (shown in FIG. 22) between the closed ends 81*a* of the slit 81 is equal to or less than 50 μm. Further, a part 50*a*, which is located between the closed ends 81*a* of the fixing portion 50, is spaced apart from the base substrate S2.

Each slit 82 comprises a part that extends along the portion of the fixing portion 50 to which the fixed contact electrode 72 is joined and also comprises a pair of closed ends 82*a*. FIG. 22 has a dotted line that extends along the slit 82 for the sake of clarifying the illustration. In this embodiment, part of the slit 82 overlaps part of the slit 81. The distance d5 (shown in FIG. 22) between the closed ends 82*a* of the slit 82 is equal to or less than 50 μm. Further, a part, which is located between the closed ends 82*a* of the fixing portion 50, is spaced apart from the base substrate S2.

Each slit 83 comprises a part that extends along the portion of the fixing portion 50 to which the fixed contact electrode 73 is joined and also comprises a pair of closed ends 83*a*. FIG. 22 has a double-dotted chain line that extends along the slit 83 for the purpose of clarifying the illustration. In this embodiment, part of the slit 82 overlaps part of the slit 81 and part of the other slit 83. The distance d6 (shown in FIG. 22) between the closed ends 83*a* of the slit 83 is equal to or less than 50 μm. Further, a part, which is located between the closed ends 83*a* of the fixing portion 50, is spaced apart from the base substrate S2, as shown in FIG. 23.

When a prescribed electric potential is supplied to any of the drive electrodes 74 of a microswitching element X4 with this constitution, an electrostatic force of attraction is produced between that drive electrode 74 and the drive electrode 75 facing that drive electrode 74. As a result, the corresponding movable portion 60 is elastically deformed to a position where the movable contact portion 71 contacts the fixed contact electrodes 72 and 73 and the contact portions 72*a* and 73*a*. Thus, the closed state of one channel of the microswitching element X4 is achieved. In the closed state of one channel, the fixed contact electrodes 72 and 73 are electrically connected by the movable contact portion 71 and therefore current is allowed to pass between the fixed contact electrodes 72 and 73. Thus, the on-state of the high frequency signal, for example, can be achieved for this channel. In the case of the microswitching element X4 in which slit 81, which comprises a part that extends along a part of the drive electrode 74 which is on the fixing portion 50 and the distance between the closed ends 81*a* of which is short, slit 82, which comprises a part that extends along the point of the fixing portion 50 at which the fixed contact electrodes 72 are joined and of which the distance between the closed ends 82*a* thereof is short, and slit 83, which comprises a part that extends along the point of the fixing portion 50 at which the fixed contact electrodes 72 are joined and of which the distance between the closed ends 83*a* thereof is short, are provided, leakage of a high frequency signal to the fixing portion 50 and base substrate S2 is suppressed. In addition, a constitution in which part 50*a*, which is located between the closed ends 81*a* of the fixing portion 50, a part 50*b*, which is located between the closed ends 82*a*, and a part 50*c*, which is located between the closed ends 83*a* are spaced apart from the base substrate S2 is also conducive to the suppression of the leakage of a high frequency signal.

When the electrostatic force of attraction acting between the drive electrodes 74 and 75 ceases to exist as a result of termination of the supply of the electric potential to the drive electrode 74 of the channel in the closed state, the corresponding movable portion 60 returns to the natural state and the movable contact portion 71 is spaced apart from between the fixed contact electrodes 72 and 73. Thus, the open state of one channel of the microswitching element X4 is achieved. In the open state of one channel, the fixed contact electrodes 72 and 73 are electrically isolated and the passage of current between the fixed contact electrodes 72 and 73 is prevented. Thus, the off-state of a high frequency signal, for example, can be achieved in this channel.

In the case of the microswitching element X4, the opening and closing of four channels can be controlled as detailed above by selectively controlling electrical potential applied to each of the four drive electrodes 74. That is, the microswitching element X4 is a so-called SP4T (single pole 4 through)—type switch.

The microswitching element X4 described above can be fabricated by undertaking the same process as that for the microswitching element X1. Therefore, the fixed contact electrodes 72 and 73 of the microswitching element X4 can be afforded a thickness that is sufficient in order to implement the desired low resistance. Further, in the case of the microswitching element X4, the lower surface of the contact portions 72*a* and 73*a* of the fixed contact electrodes 72 and 73 (that is, the surface to contact the movable contact portion 71) is very flat and, therefore, an air gap between the movable contact portion 71 and the contact portions 72*a* and 73*a* can be provided with high dimensional accuracy. In addition, the micro switching element X4 can be suitably fabricated by avoiding detachment of the movable contact portion 71, fixed contact electrodes 72 and 73, and drive electrodes 74 and 75. This kind of microswitching element X4 is suitable on account of reducing insertion loss in the closed state.

Figure 25:
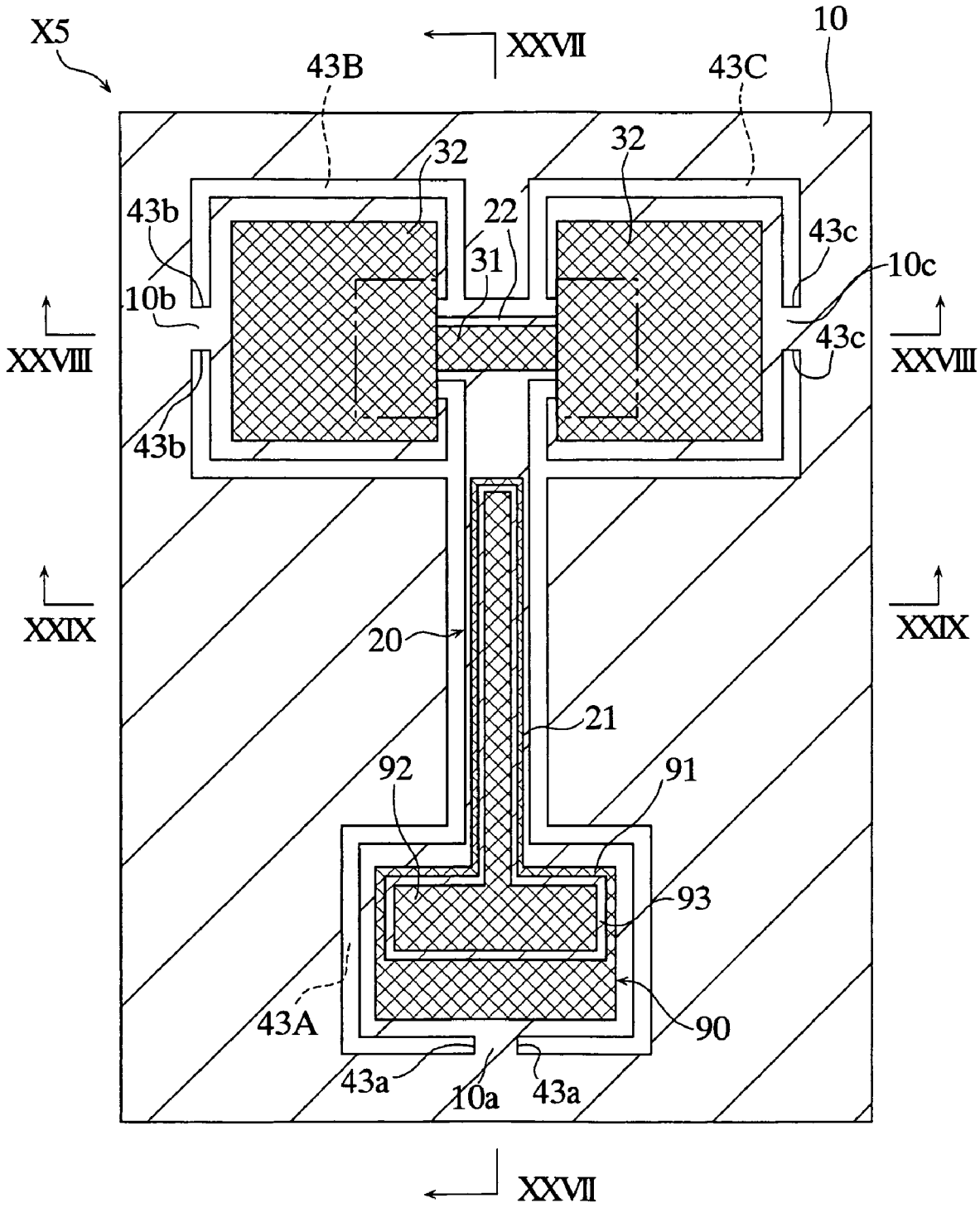
FIG. 25 is a planar view of a microswitching element according to a fifth embodiment of the present invention.
Figure 26:
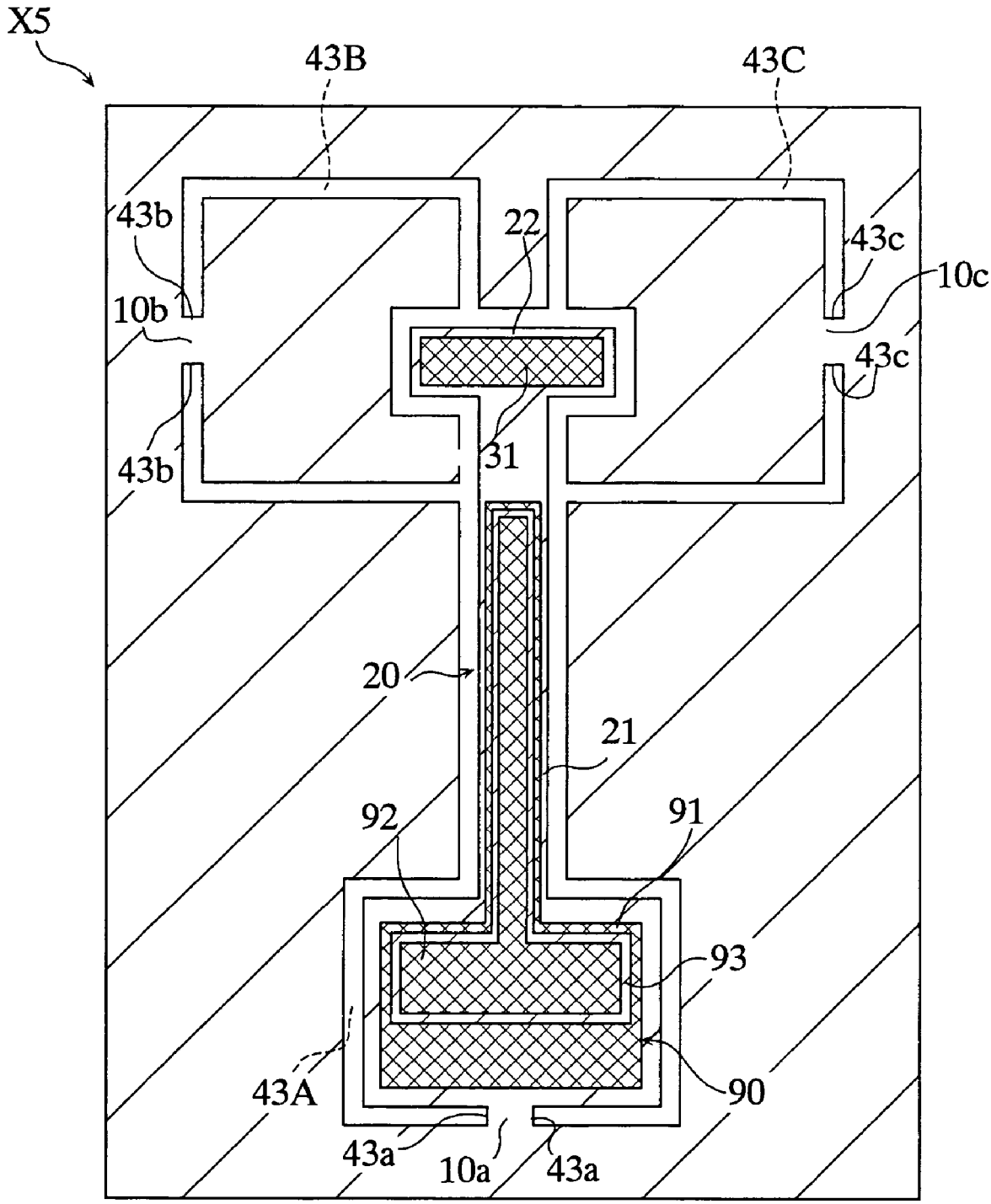
FIG. 26 is a planar view in which a part of the microswitching element in FIG. 25 is omitted.
Figure 27:
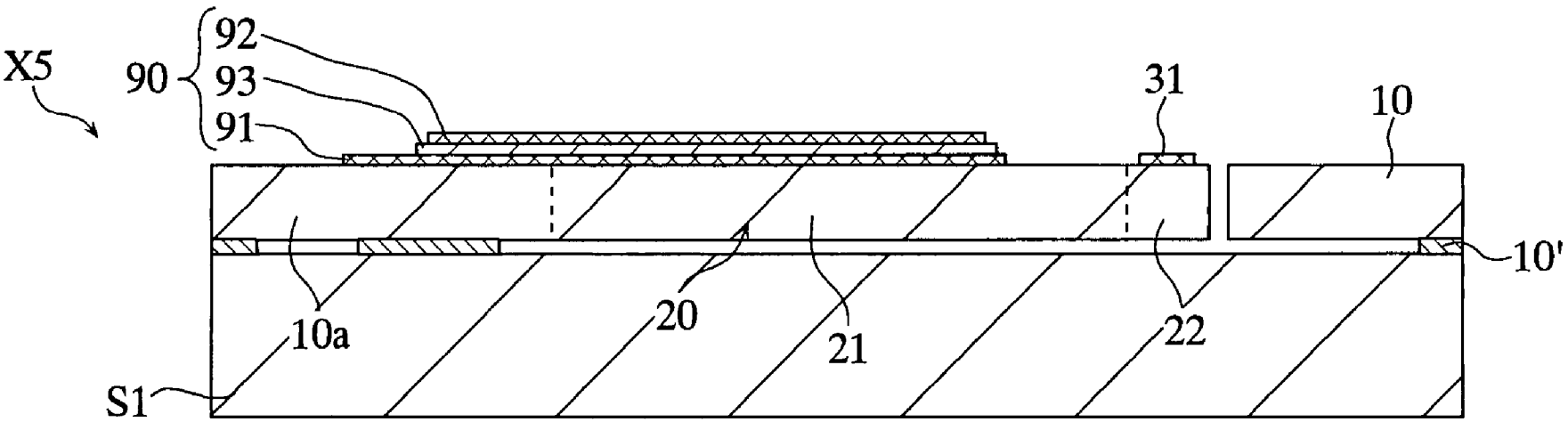
FIG. 27 is a cross-sectional view along the line XXVII-XXVII in FIG. 25.

FIGS. 25 to 27 show a microswitching element X5 according to a fifth embodiment of the present invention. FIG. 25 is a planar view of the microswitching element X5. FIG. 26 is a planar view in which part of the microswitching element X5 is omitted. FIG. 27 is a cross-sectional view along the line XXVII-XXVII in FIG. 25.

The microswitching element X5 comprises a base substrate S1, a fixing portion 10, a movable portion 20, a movable contact portion 31, a pair of fixed contact electrodes 32 (omitted from FIG. 26), a piezoelectric drive portion 90, slits 43A, 43B and 43C, and differs from the micro switching element X3 by virtue of comprising the piezoelectric drive portion 90 instead of the drive electrodes 33 and 34.

The piezoelectric drive portion 90 comprises drive electrodes 91 and 92 and a piezoelectric film 93 between the drive electrodes 91 and 92. The drive electrodes 91 and 92 each have a layered structure consisting of a Ti base layer and an Au principal layer, for example. The drive electrode 92 is connected to ground via prescribed wiring (not shown). The piezoelectric film 93 is made of a piezoelectric material that exhibits the quality that strain is produced by applying an electric field (inverse piezoelectric effect). PZT (a solid solution of $PbZrO_3$ and $PbTiO_3$), ZnO doped with Mn, ZnO, or AlN can be adopted as such a piezoelectric material. The thickness of the drive electrodes 91 and 92 is 0.55 μm, for example, and the thickness of the piezoelectric film 93 is 1.5 μm, for example.

When a prescribed positive electric potential is supplied to the drive electrode 91 and a prescribed negative electric potential is supplied to the drive electrode 92 of a micro switching element X5 with this constitution, an electric field is produced between the drive electrode 91 and drive electrode 92 and a contraction force is produced in an in-plane direction within the piezoelectric film 93. The further away from the drive electrode 91 that is directly supported by the movable portion 20, that is, the closer to the drive electrode 92, the more readily contracted in an in-plane direction the piezoelectric material in the piezoelectric film 93 becomes. As a result, the in-plane direction contraction amount arising from the contraction force gradually increases moving from the side of the drive electrode 91 in the piezoelectric film 93 toward the side of the drive electrode 92, and the movable portion 20 is elastically deformed to a position where the movable contact portion 31 contacts the pair of fixed contact electrodes 32. Thus, the closed state of the microswitching element X4 is achieved. In the closed state, the fixed contact electrodes 32 are electrically connected by the movable contact portion 31 and current is allowed to pass between the fixed contact electrodes 32. Thus, the on-state of the high frequency signal, for example, can be achieved. In the case of the microswitching element X5 in which a slit 43A, which comprises a part that extends along a part of the drive electrode 91 which is on the fixing portion 10 and the distance between the closed ends 43*a* of which is short, a slit 43B, which comprises a part that extends along the point of the fixing portion 10 at which the fixed contact electrodes 32 are joined and of which the distance between the closed ends 43*b* thereof is short, and a slit 43C, which comprises a part that extends along the point of the fixing portion 10 at which the fixed contact electrodes 32 are joined and of which the distance between the closed ends 43*c* thereof is short, are provided, leakage of a high frequency signal to the fixing portion 10 and base substrate S1 is suppressed. In addition, a constitution in which part 10*a*, which is located between the closed ends 43*a* of the fixing portion 10, part 10*b* that is located between the closed ends 43*b*, and part 10*c* that is located between the closed ends 43*c* are spaced apart from the base substrate S1 is also conducive to the suppression of the leakage of a high frequency signal.

In the case of the microswitching element X5 in the closed state, when the electric field between the drive electrodes 91 and 92 ceases to exist as a result of termination of the supply of the electric potential to the piezoelectric drive portion 90, the piezoelectric film 93 and the movable portion 20 return to the natural state and the movable contact portion 31 is spaced apart from the fixed contact electrodes 32. Thus, the open state of the microswitching element X5 is achieved. In the open state, the pair of fixed contact electrodes 32 is electrically isolated and the passage of current between the fixed contact electrodes 32 is prevented. Thus, the off-state of a high frequency signal, for example, can be achieved.

FIGS. 28 to 31 show the fabrication method of the microswitching element X5 with the variation in the cross-section along the lines XXVIII-XXVIII and XXIX-XXIX in FIG. 25. In the fabrication of the microswitching element X5, the substrate S' shown in FIG. 28A is first prepared. The substrate S' is an SOI substrate and comprises a layered structure consisting of a first layer 101, a second layer 102, and an intermediate layer 103 between the first layer 101 and second layer 102. In this embodiment, for example, the thickness of the first layer 101 is 10 μm, the thickness of the second layer 102 is 400 μm, and the thickness of the intermediate layer 103 is 2 μm. The first layer 101 and second layer 102 are parts that are made of monocrystalline silicon, for example, and which are processed to produce the fixing portion 10 and movable portion 20. The intermediate layer 103 is a part that is made of an insulating substance in this embodiment and which is processed to produce the boundary layer 10'. Silicon dioxide or silicon nitride, for example, can be adopted as this insulating substance.

Figures 28A, 28B, 28C, 28D:
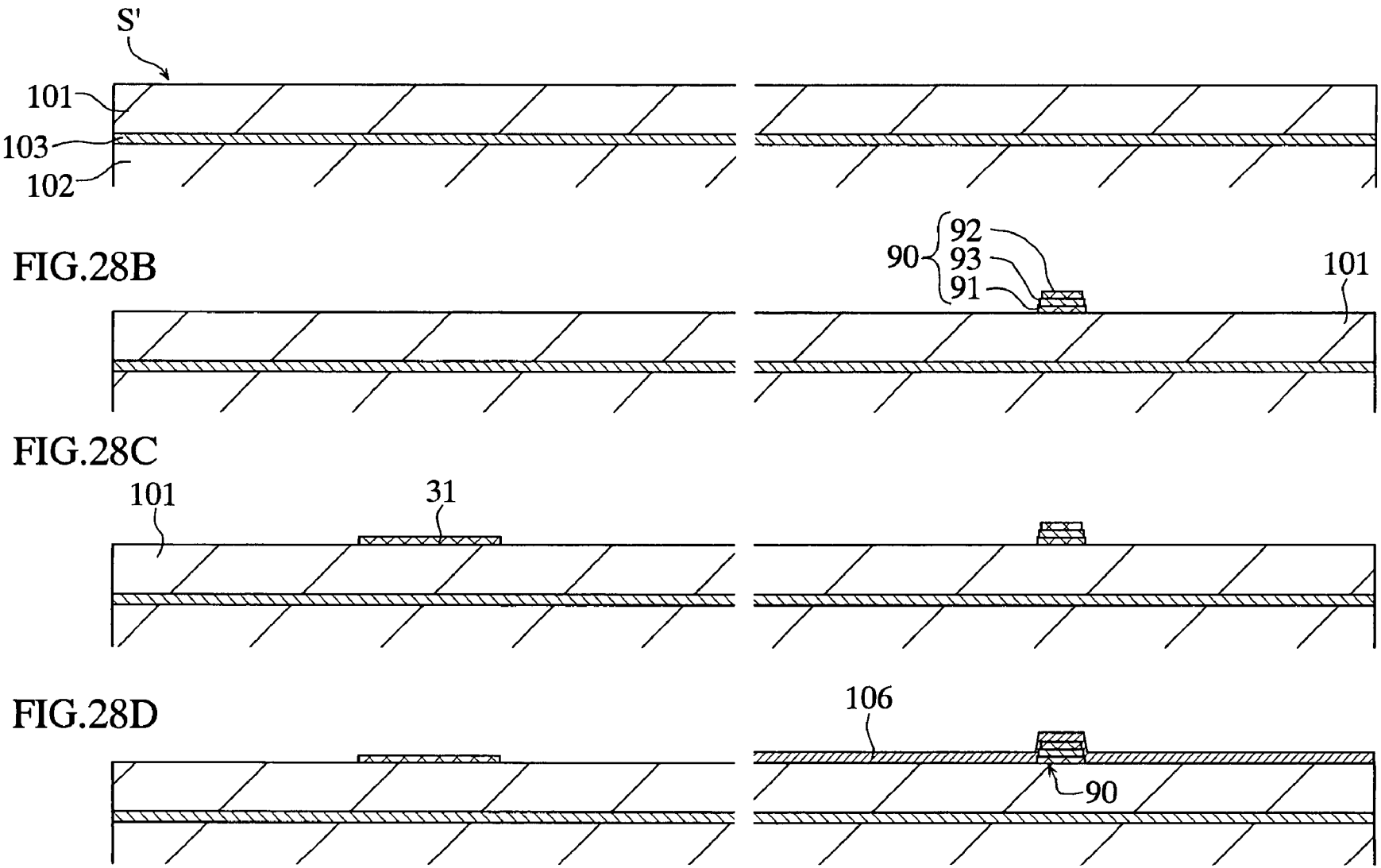
FIG. 28 shows steps of a part of the fabrication method of the microswitching element shown in FIG. 25.

Thereafter, as shown in FIG. 28B, the piezoelectric drive portion 90 is formed on the first layer 101 of the substrate S'. In the formation of the piezoelectric drive portion 90, a first electrically conductive film is formed on the first layer 101. Thereafter, a piezoelectric material film is formed on the first electrically conductive film. A second piezoelectric material film is then formed on the piezoelectric film. Thereafter, each film is patterned by means of photolithography and then etching. The first and second electrically conductive films can be formed by depositing Ti, for example, and then Au, for example, on the Ti by means of sputtering, for example. The thickness of the Ti film is 50 nm, for example, and the thickness of the Au film is 500 nm, for example. The piezoelectric material can be formed by depositing a prescribed piezoelectric material by means of sputtering, for example.

Thereafter, as shown in FIG. 28C, the movable contact portion 31 is formed on the first layer 101. More specifically, this formation is the same as that mentioned earlier with reference to FIG. 6B with respect to the formation of the movable contact portion 31 of the microswitching element X1.

Thereafter, as shown in FIG. 28D, a protective film 106 for covering the piezoelectric drive portion 90 is formed. For example, the protective film 106 can be formed by depositing Si by means of sputtering via a prescribed mask. The thickness of the protective film 106 is 300 nm, for example.

Figures 29A, 29B, 29C:
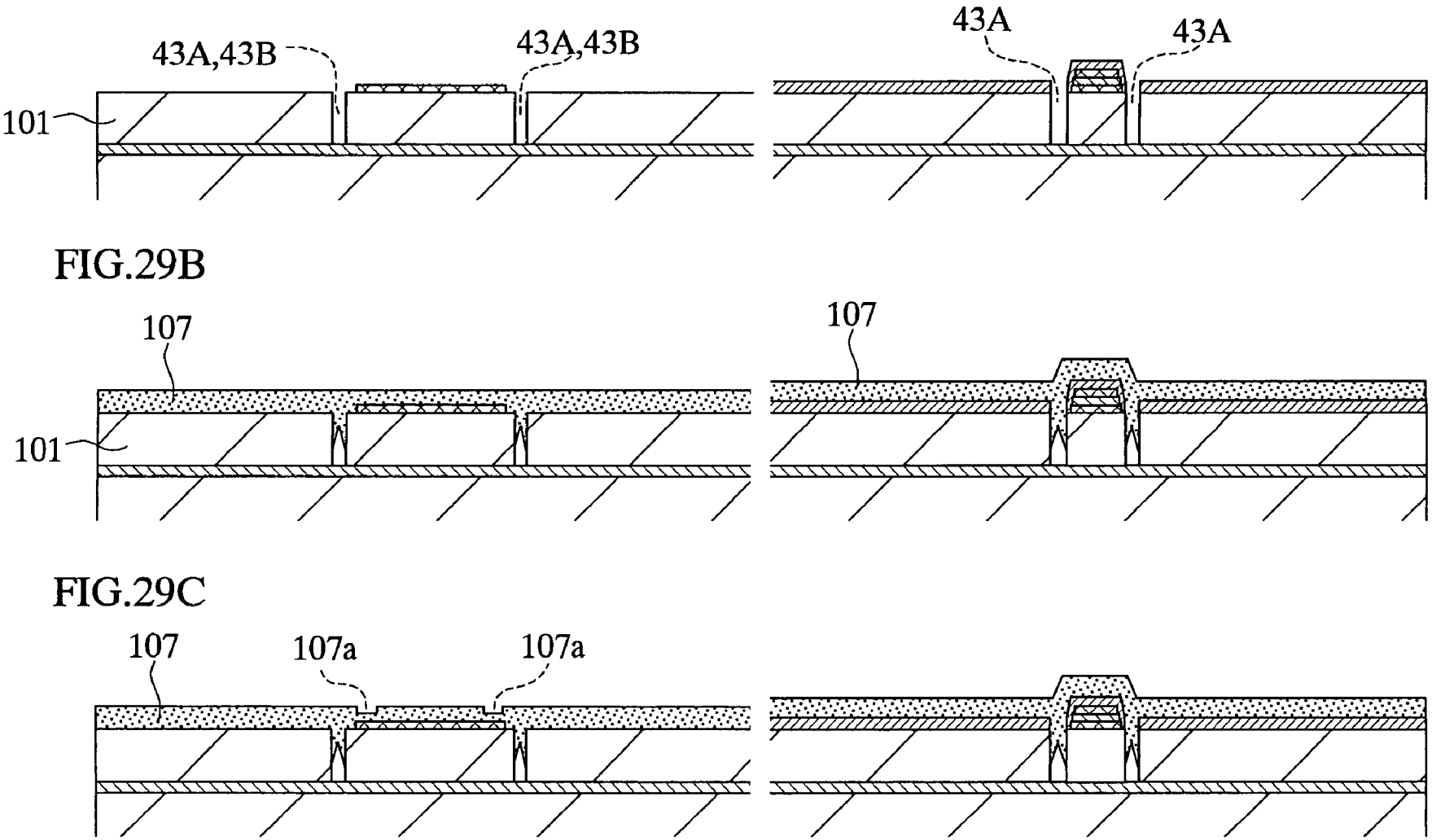
FIG. 29 shows steps that succeed the steps in FIG. 28.

In the fabrication of the microswitching element X5, the slits 43A and 43B are then produced by etching the first layer 101 as shown in FIG. 29A. More specifically, the production method is the same as the production method of the slit 41 described with reference to FIG. 6C.

Thereafter, as shown in FIG. 29B, a sacrificial film 107 is produced on the side of the first layer 101 of the substrate S' to block the slits 43A and 43B. More specifically, the production method is the same as the production method of the sacrificial layer 104 mentioned earlier with reference to FIG. 6D.

Thereafter, as shown in FIG. 29C, two recesses 107*a* are produced at points that correspond to the movable contact portion 31 in the sacrificial layer 107. More specifically, the production method is the same as the production method of the recess 104*a* mentioned earlier with reference to FIG. 7A Each recess 107*a* serves to form the contact portion 32*a* of the fixed contact electrode 32 and has a depth of 1 μm, for example.

Figures 30A, 30B, 30C:
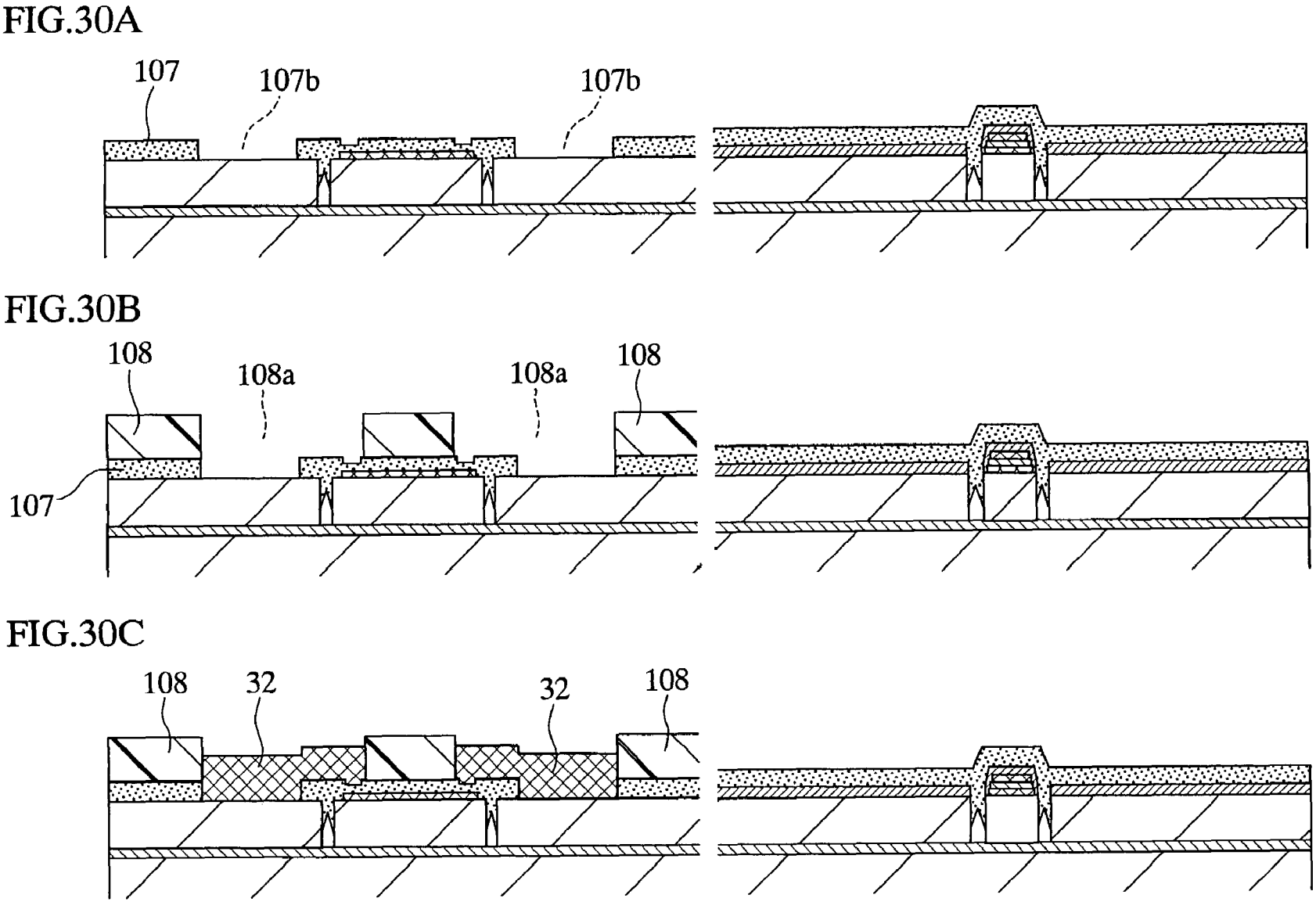
FIG. 30 shows steps that succeed the steps in FIG. 29.

Thereafter, as shown in FIG. 30A, an opening 107*b* is formed by patterning the sacrificial layer 107. More specifically, after a prescribed resist pattern has been formed on sacrificial layer 107 by means of photolithography, the sacrificial layer 107 is etched with the resist pattern serving as a mask. Wet etching can be adopted as the etching technique. The opening 107*b* serves to expose the region of the fixing portion 10 where the fixed contact electrodes 32 are joined.

Thereafter, after a current-carrying base film (not illustrated) has been formed on the surface of the side of the substrate S' where the sacrificial layer 107 is provided, a mask 108 is formed as shown in FIG. 30B. The base film can be formed by depositing Cr with the thickness of 50 nm by means of sputtering, for example, and then depositing Au with the thickness of 500 nm on the Cr. The mask 108 has an opening 108*a* corresponding to the pair of fixed contact electrodes 32.

Thereafter, as shown in FIG. 30C, the pair of fixed contact electrodes 32 is formed. More specifically, gold, for example, is grown on the base film that is exposed at the opening 108*a* by means of electroplating.

Figures 31A, 31B, 31C:
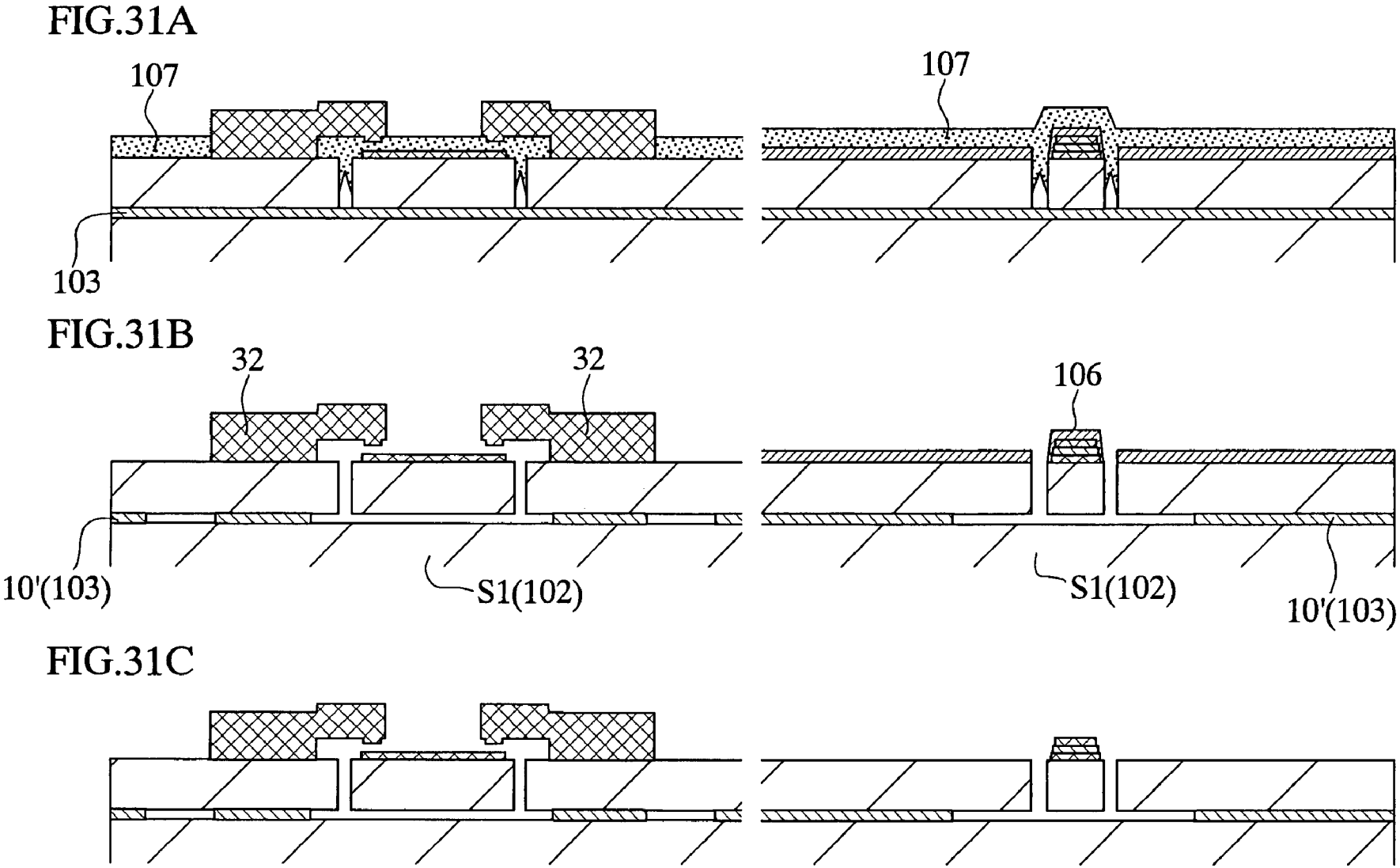
FIG. 31 shows steps that succeed the steps in FIG. 30.
Figure 32:
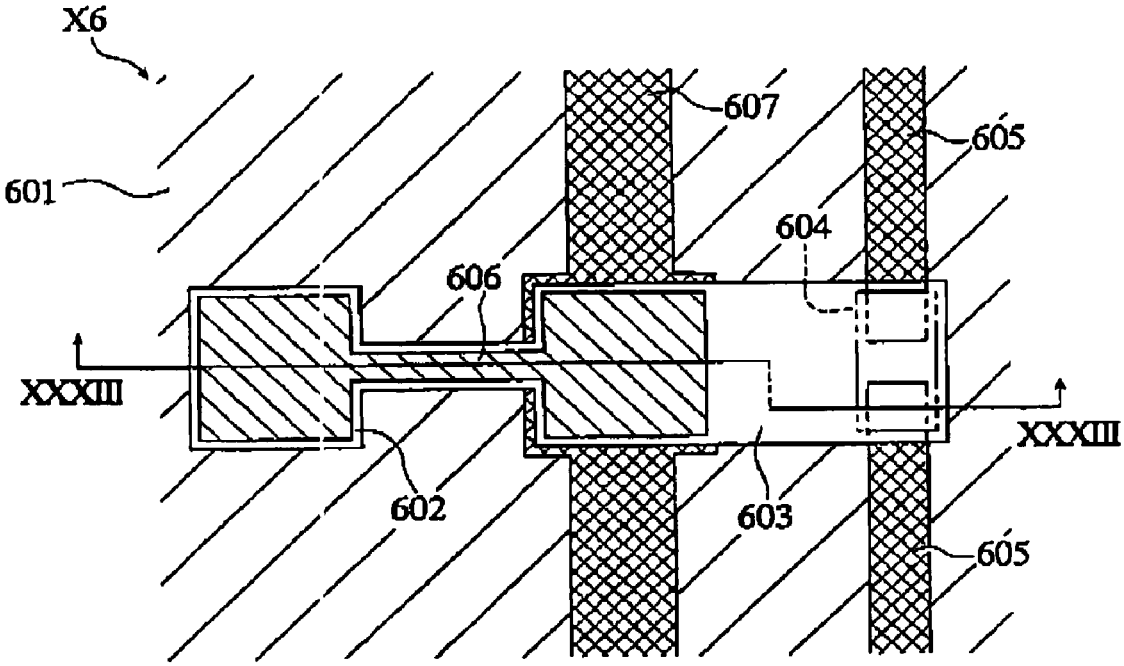
FIG.32 Prior Art
FIG. 32 is a partial planar view of a conventional microswitching element that is fabricated by using MEMS technology.
Figure 33:
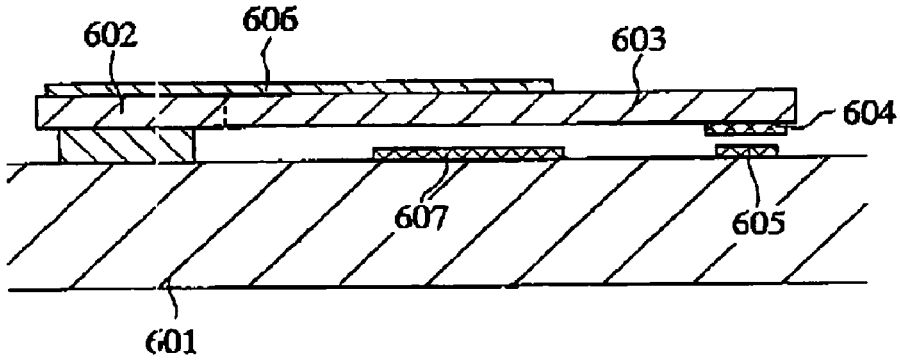
FIG.33 Prior Art
FIG. 33 is a cross-sectional view along the line XXXIII-XXXIII in FIG. 32.
Figure 34A:
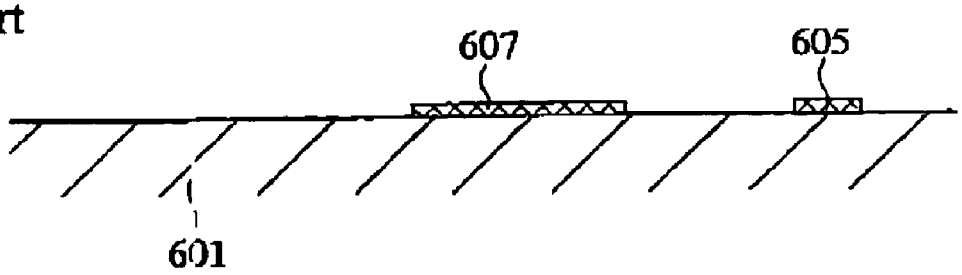
FIG.34A Prior Art
FIG. 34 shows steps of part of the fabrication method of the microswitching element in FIG. 32.
Figure 34B:
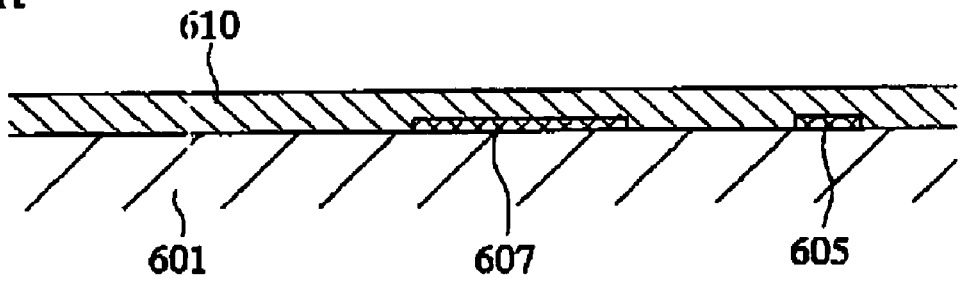
FIG.34B Prior Art
Figure 34C:
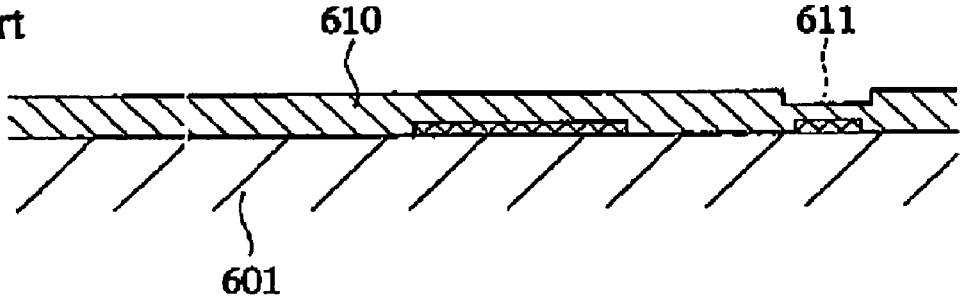
FIG.34C Prior Art
Figure 34D:
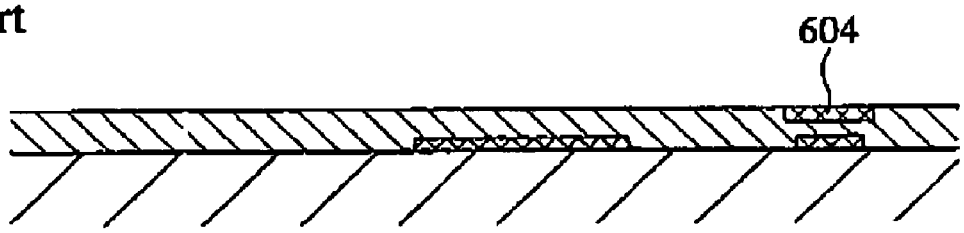
FIG.34D Prior Art
Figure 35A:
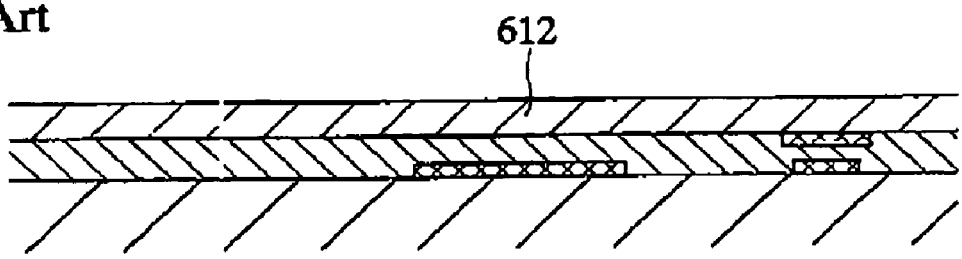
FIG.35A Prior Art
FIG. 35 shows steps that succeed the steps in FIG. 34.
Figure 35B:
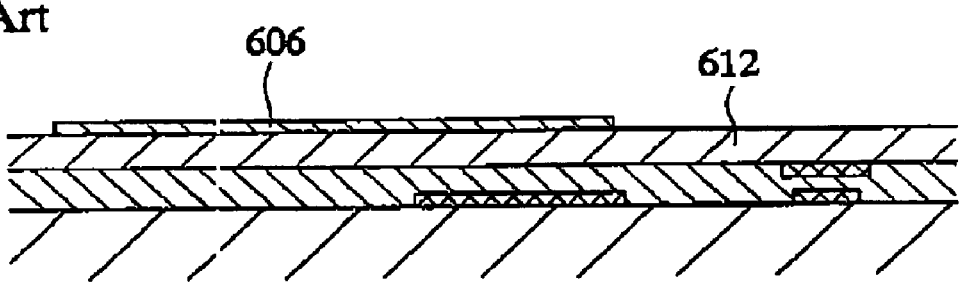
FIG.35B Prior Art
Figure 35C:
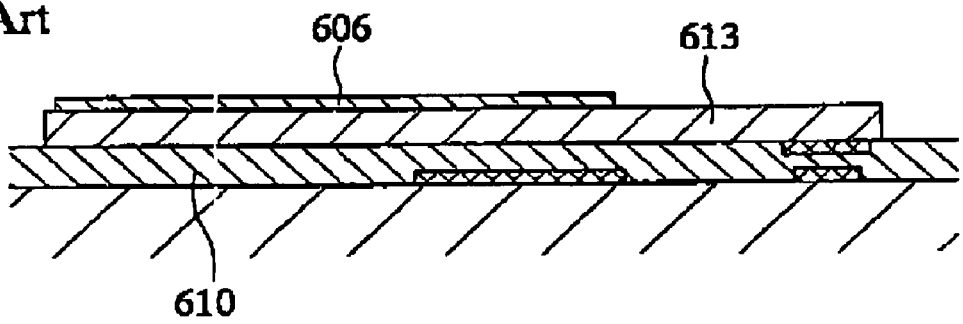
FIG.35C Prior Art
Figure 35D:
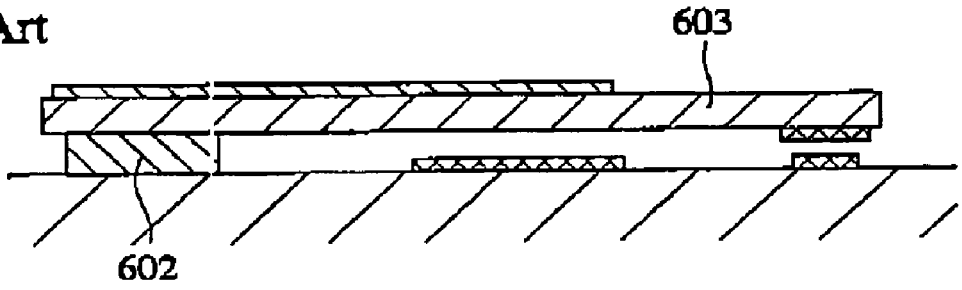
FIG.35D Prior Art

Thereafter, as shown in FIG. 31A, the mask 108 is removed through etching. The exposed part of the base film is then removed through etching. Wet etching can be adopted for this etching removal in each of the cases above.

Thereafter, as shown in FIG. 31B, the sacrificial layer 107 and part of the intermediate layer 103 are removed. More specifically, the removal method is the same as the removal method of the sacrificial layer 104 and part of the intermediate layer 103 described earlier with reference to FIG. 8C. In this step, the boundary layer 10' is residually formed from the intermediate layer 103. Further, the second layer 102 constitutes the base substrate S2.

Thereafter, if necessary, part of the base film (Cr film, for example) that is attached to the undersides of the fixed contact electrode 32 is removed through wet etching, and then the whole of the element is dried by means of supercritical drying. Thereafter, as shown in FIG. 31C, the protective film 106 is removed. As the removal technique, RIE, which uses $SF_6$ as the etching gas, can be adopted, for example.

The microswitching element X5 can be fabricated as detailed hereinabove. With the above method, the fixed contact electrodes 32 comprising the contact portion 32*a* facing the movable contact portion 31 can be formed thickly on the sacrificial layer 107 by means of plating. As a result, the pair of fixed contact electrodes 32 can be afforded a sufficient thickness. A microswitching element X5 of this kind is suitable on account of reducing insertion loss in the closed state.

In the case of the microswitching element X5, the lower surface of the contact portion 32*a* of the fixed contact electrodes 32 (that is, the face that makes contact with the movable contact portion 31) is very flat and, therefore, the air gap between the movable contact portion 31 and the contact portion 32*a* can be provided with high dimensional accuracy. An air gap with high dimensional accuracy is suitable on account of reducing insertion loss in the closed state and is also suitable by virtue of improving the isolation characteristics in the open state.

In addition, similarly to the microswitching element X1, the microswitching element X5 can be suitably fabricated by avoiding detachment of the movable contact portion 31 and fixed contact electrodes 32. This kind of microswitching element X5 is suitable on account of reducing insertion loss in the closed state.

The invention claimed is:

1. A microswitching element, comprising:

a first layer having a first surface and a second surface opposite to the first surface; and a second layer attached to the first surface of the first layer via an intermediate separation layer;

wherein the second layer includes a base substrate;

wherein the first layer comprises a fixing portion fixed to the base substrate via the intermediate separation layer;

wherein the first layer also comprises a movable portion including a fixed end fixed to the fixing portion, the movable portion extending along the base substrate with a portion of the intermediate separation layer removed between the movable portion and the base substrate, the movable portion being surrounded by the fixing portion via a slit including a pair of closed ends; and wherein the microswitching element further comprises:

a movable contact electrode provided on the second surface of the first layer at the movable portion;

a pair of fixed contact electrodes each provided on the second surface of the first layer and including a contact surface facing the movable contact electrode, the fixed contact electrodes being attached to the fixing portion;

a first drive electrode formed on the second surface of the layer to extend along the movable portion; and a second drive electrode formed on the second surface of the first layer in facing relationship to the first drive electrode, the second drive electrode being attached to the fixing portion.

2. The microswitching element according to claim 1, wherein the first drive electrode extends from the fixing portion onto the movable portion, the second drive electrode crossing the first drive electrode.

3. The microswitching element according to claim 1, further comprising: a first drive electrode provided on the second surface of the movable portion and on the fixing portion; a piezoelectric film provided on the first drive electrode; and a second drive electrode provided on the piezoelectric film.

4. The microswitching element according to claim 2, wherein the first drive electrode includes a part provided on the fixing portion, the slit including a part extending along said part of the first drive electrode.

5. The microswitching element according to claim 1, further comprising an additional slit including a pair of closed ends, wherein the additional slit includes a portion extending along one of the fixed contact electrodes.

6. The microswitching element according to claim 4, wherein the fixing portion includes a region located between the closed ends of the slit, said region being spaced apart from the base substrate.

7. The microswitching element according to claim 6, wherein a separation distance between the closed ends of the slit is no greater than 50 μm.

8. The switching element according to claim 1, wherein the movable contact electrode and the fixed contact electrodes contain at least one of gold, platinum, palladium and ruthenium.

9. The microswitching element according to claim 1, wherein the first layer is made of a silicon material having a resistivity of no smaller than 1000 Ω·cm.

10. The microswitching element according to claim 1, wherein the first layer is made of an N-type silicon material.

11. The mioroswitching element according to claim 1, wherein the movable portion is formed with a recess in the second surface, the movable contact portion including a protrusion protruding into the recess.

* * * * *